US012623281B2

(12) United States Patent
Yonezawa

(10) Patent No.: US 12,623,281 B2
(45) Date of Patent: May 12, 2026

(54) OXIDE-CONTAINING COPPER FINE PARTICLES, METHOD FOR PRODUCING SAME, AND METHOD FOR PRODUCING SINTERED COMPACT USING OXIDE-CONTAINING COPPER FINE PARTICLES

(71) Applicant: National University Corporation Hokkaido University, Sapporo (JP)

(72) Inventor: Tetsu Yonezawa, Sapporo (JP)

(73) Assignee: National University Corporation Hokkaido University, Sapporo (JP)

( * ) Notice: Subject to any disclaimer, the term of this patent is extended or adjusted under 35 U.S.C. 154(b) by 414 days.

(21) Appl. No.: 17/921,447

(22) PCT Filed: Aug. 26, 2021

(86) PCT No.: PCT/JP2021/031373

§ 371 (c)(1),
(2) Date: Oct. 26, 2022

(87) PCT Pub. No.: WO2022/045252

PCT Pub. Date: Mar. 3, 2022

(65) Prior Publication Data

US 2023/0173578 A1 Jun. 8, 2023

(30) Foreign Application Priority Data

Aug. 28, 2020 (JP) ..... 2020-144680

(51) Int. Cl.
*B22F 1/102* (2022.01)
*B22F 7/04* (2006.01)
(Continued)

(52) U.S. Cl.
CPC ..... *B22F 1/102* (2022.01); *B22F 7/04* (2013.01); *B22F 9/04* (2013.01); *B22F 2009/043* (2013.01); *B22F 9/10* (2013.01); *B22F 2301/10* (2013.01); *B22F 2302/25* (2013.01); *B22F 2302/45* (2013.01)

(58) Field of Classification Search
None
See application file for complete search history.

(56) References Cited

U.S. PATENT DOCUMENTS

2020/0376546 A1 12/2020 Yonezawa et al.

FOREIGN PATENT DOCUMENTS

JP 2015-214722 A 12/2015
JP 2017-001978 A 1/2017
(Continued)

OTHER PUBLICATIONS

English translation of JP 2020-029392 (originally published Feb. 27, 2022), obtained from Espacenet.*
(Continued)

*Primary Examiner* — Jennifer A Boyd
(74) *Attorney, Agent, or Firm* — Morgan, Lewis & Bockius LLP

(57) ABSTRACT

Disclosed is oxide-containing copper fine particles including $Cu_{64}O$ and optionally $Cu_2O$ and coated with a carboxylic acid, wherein a mass ratio of $Cu_{64}O$ to a total mass of Cu, $Cu_{64}O$ and $Cu_2O$ is 0.5 to 2.0% by mass.

20 Claims, 17 Drawing Sheets

(51) Int. Cl.
*B22F 9/04* (2006.01)
*B22F 9/10* (2006.01)

(56) References Cited

FOREIGN PATENT DOCUMENTS

| | | | |
|---|---|---|---|
| JP | 2020-029392 | A | 2/2020 |
| JP | 2020-100893 | A | 7/2020 |
| WO | 2016/125581 | A1 | 8/2016 |
| WO | 2019/106739 | A1 | 6/2019 |
| WO | 2020/035859 | A2 | 2/2020 |

OTHER PUBLICATIONS

English translation of JP 2020-100893 (originally published Jul. 2, 2022), obtained from Espacenet.*
International Search Report issued in corresponding International Patent Application No. PCT/JP2021/031373 dated Nov. 9, 2021.
International Preliminary Report on Patentability and Written Opinion issued in corresponding International Patent Application No. PCT/JP2021/031373 dated Mar. 9, 2023.
Matsubara et al., "Effect of Glass Transition Temperature of Stabilizing Polymer of Air-Stable Gelatin-Stabilized Copper Fine Particles during Redox Two-Step Low-Temperature Sintering Process," Bulletin of The Chemical Society of Japan, 88(12): 1755-1759 (2015) XP093112017, JP ISSN: 0009-2673, DOI: 10.1246/bcsj.20150305.
Extended European Search report dated Jan. 3, 2024, issued in corresponding European Patent Application No. 21861674.6.

* cited by examiner

[FIG. 1]
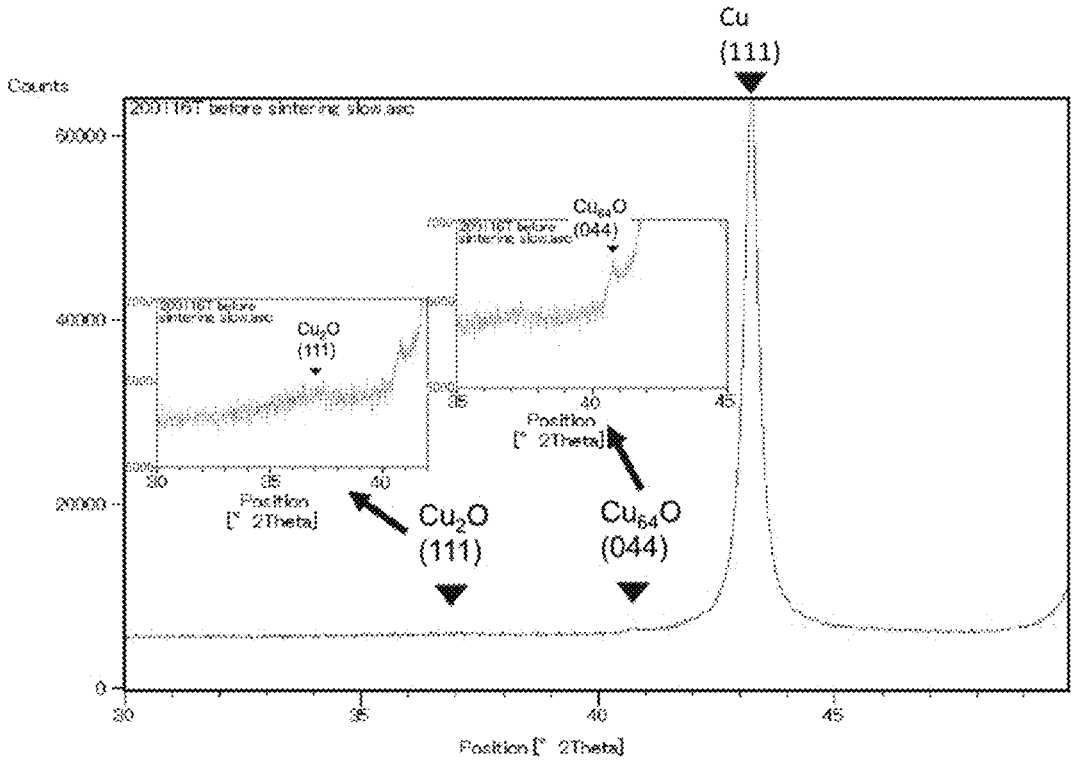

[FIG. 2]
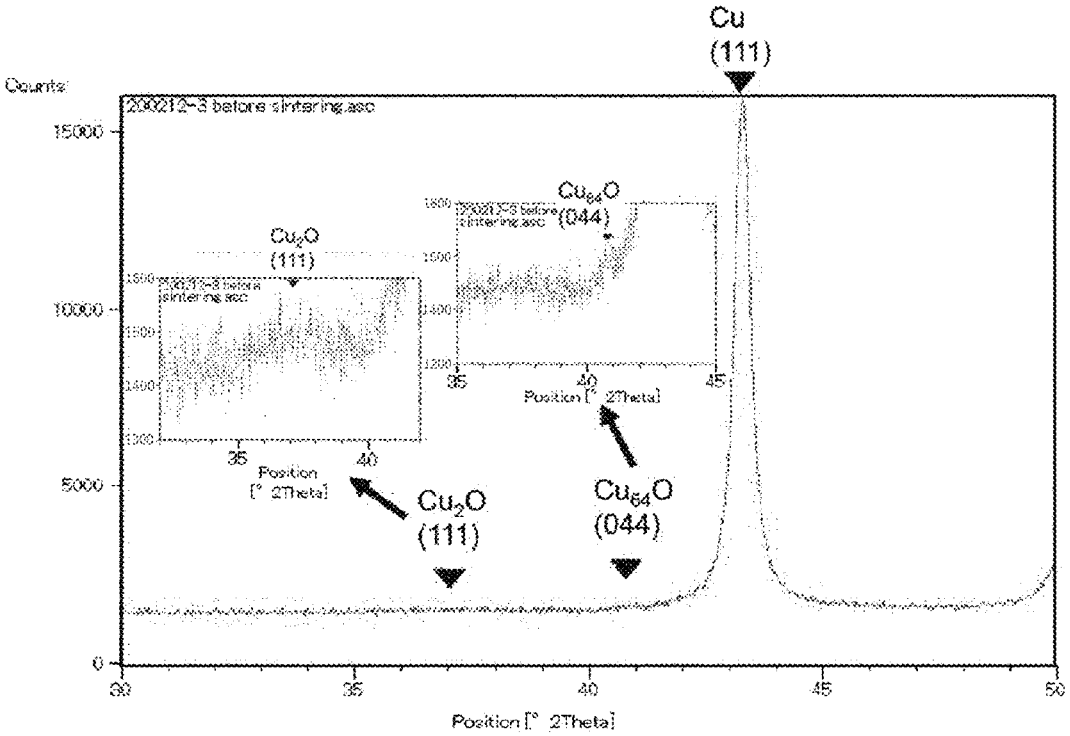

[FIG. 3]
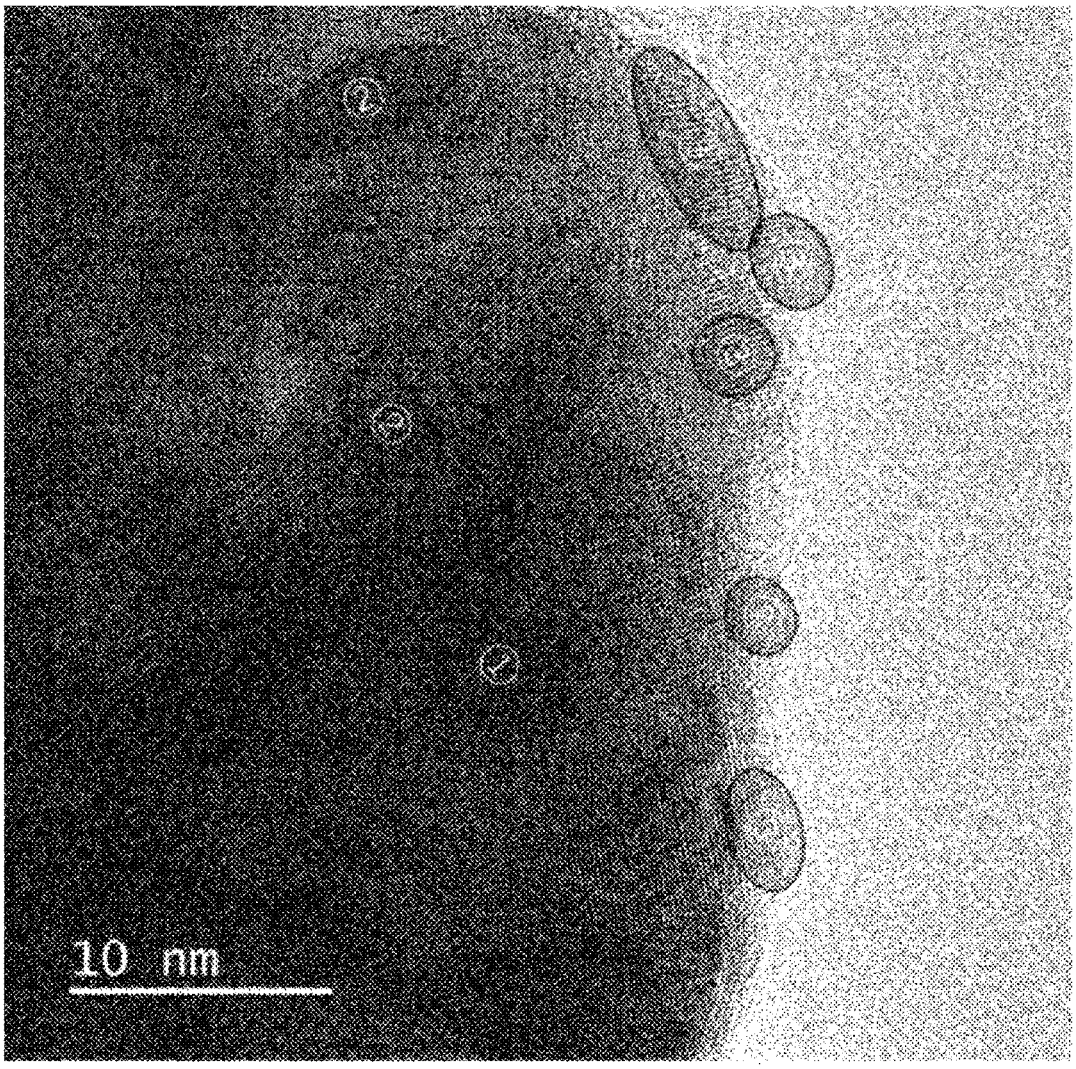
① : Cu, ② : $Cu_{64}O$, ③ : $Cu_2O$

[FIG. 4]
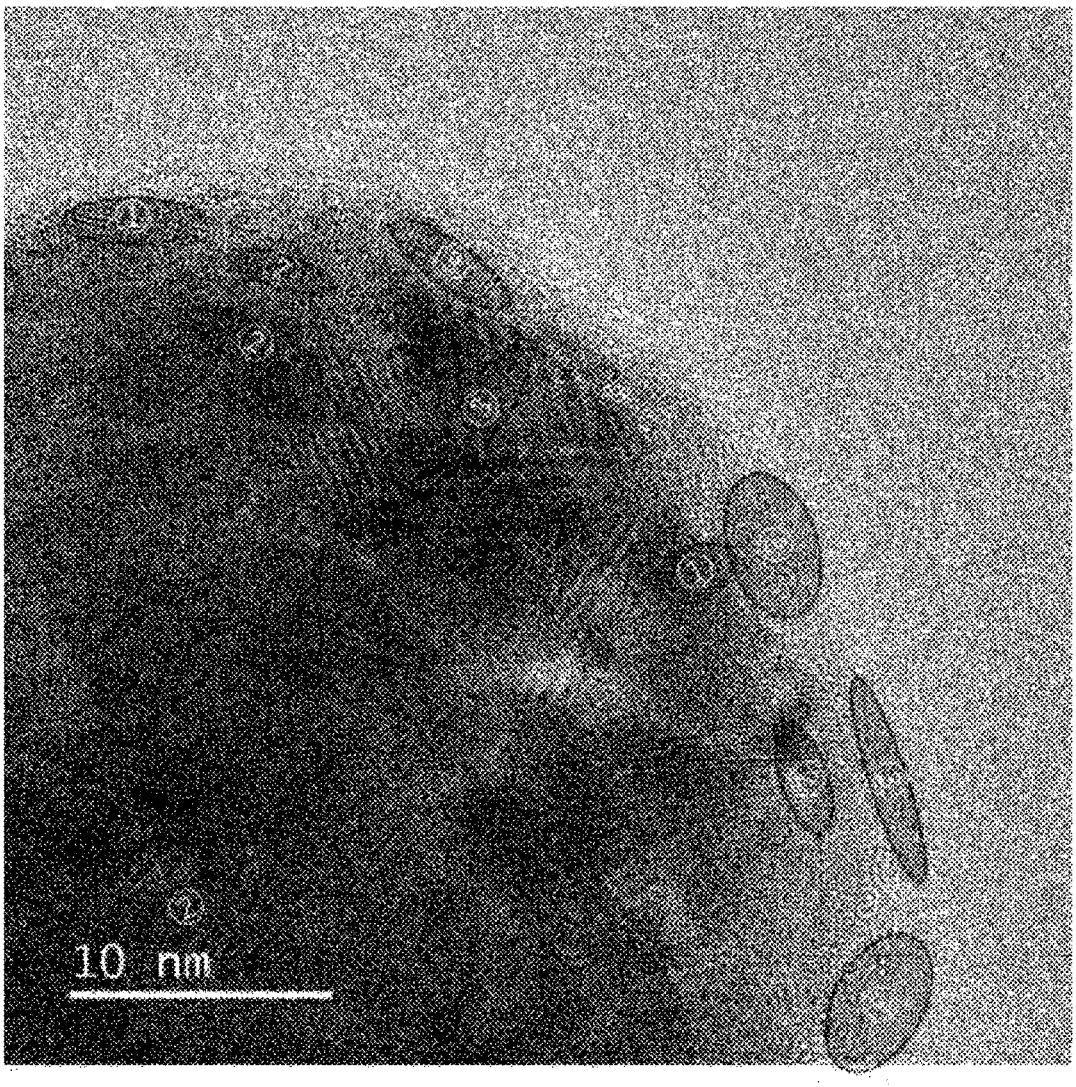
① : Cu, ② : $Cu_{64}O$, ③ : $Cu_2O$

[FIG. 5]
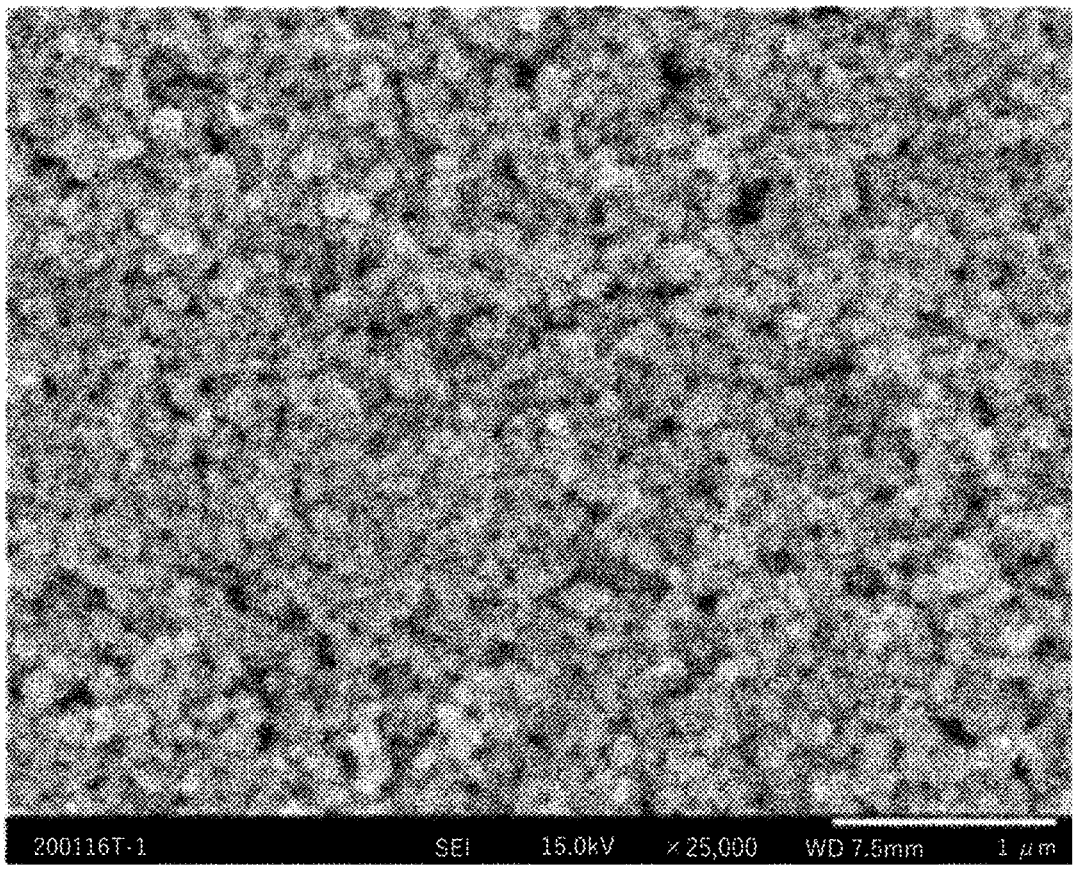

[FIG. 6]
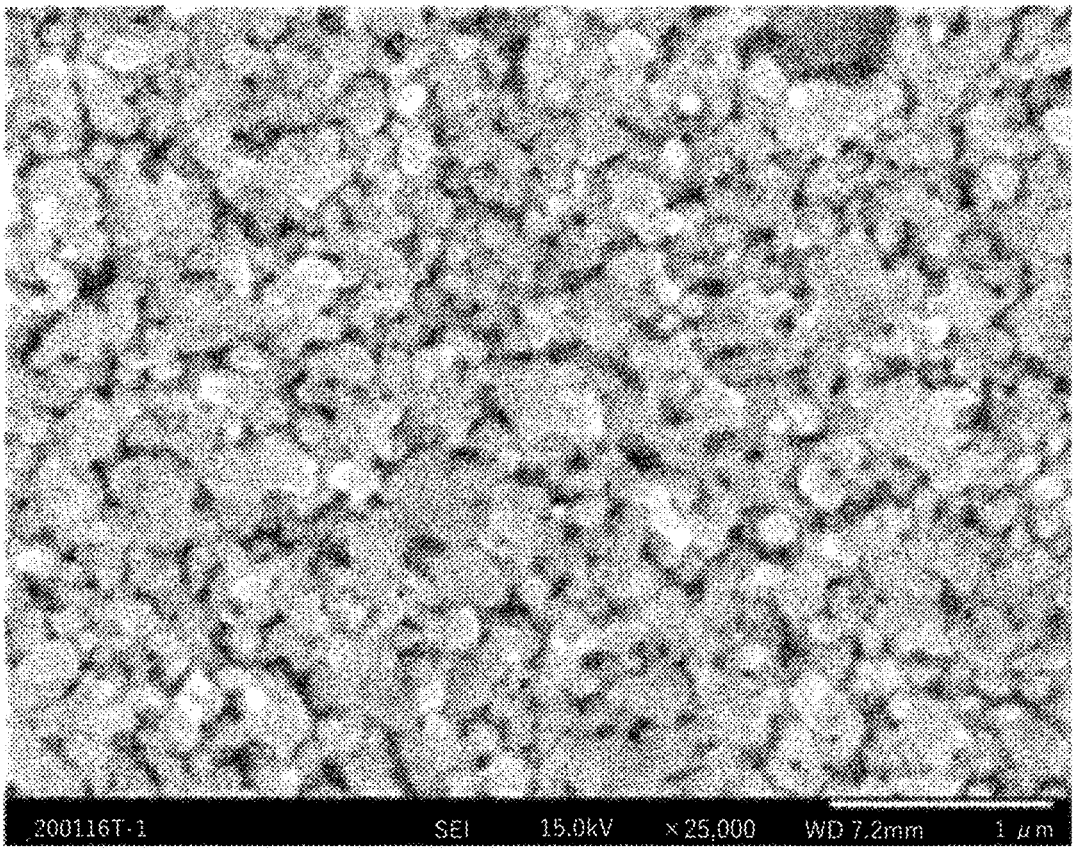

[FIG. 7]
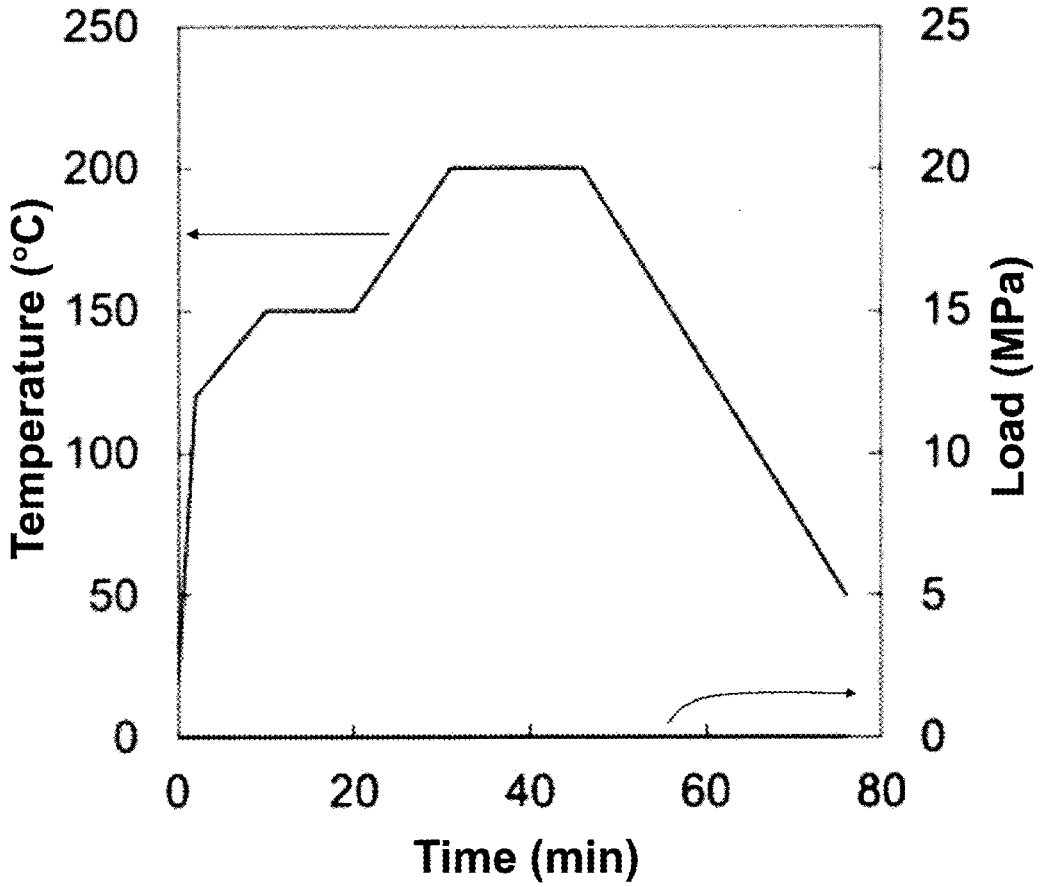

[FIG. 8]
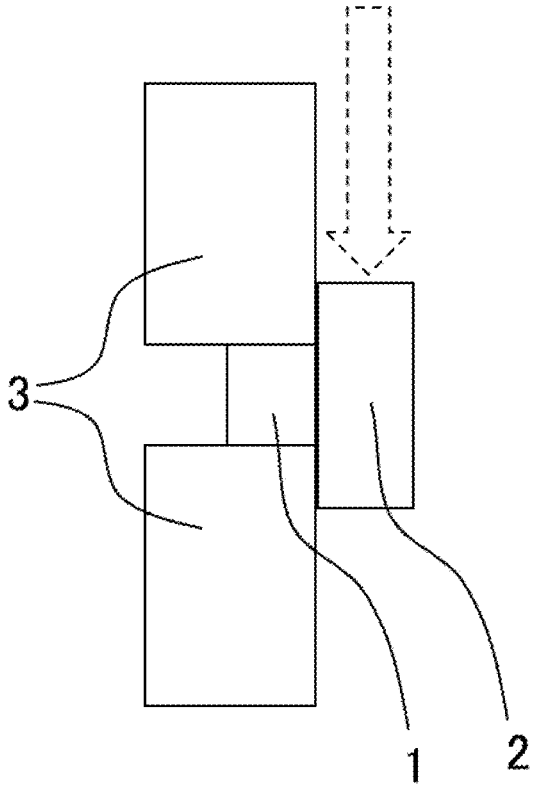

[FIG. 9]
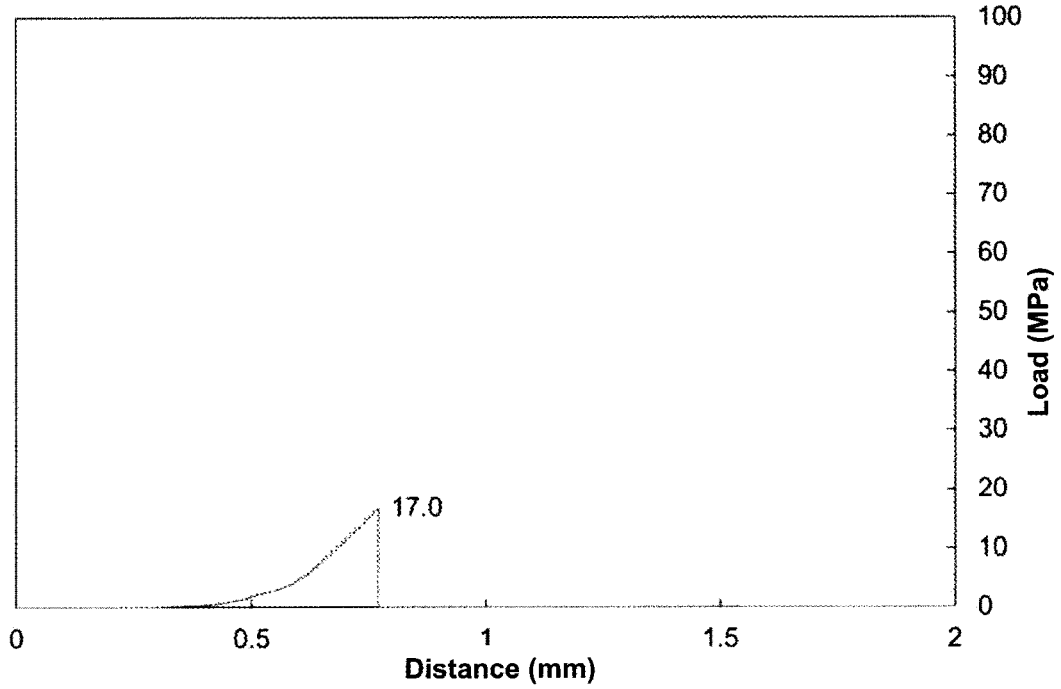

[FIG. 10]
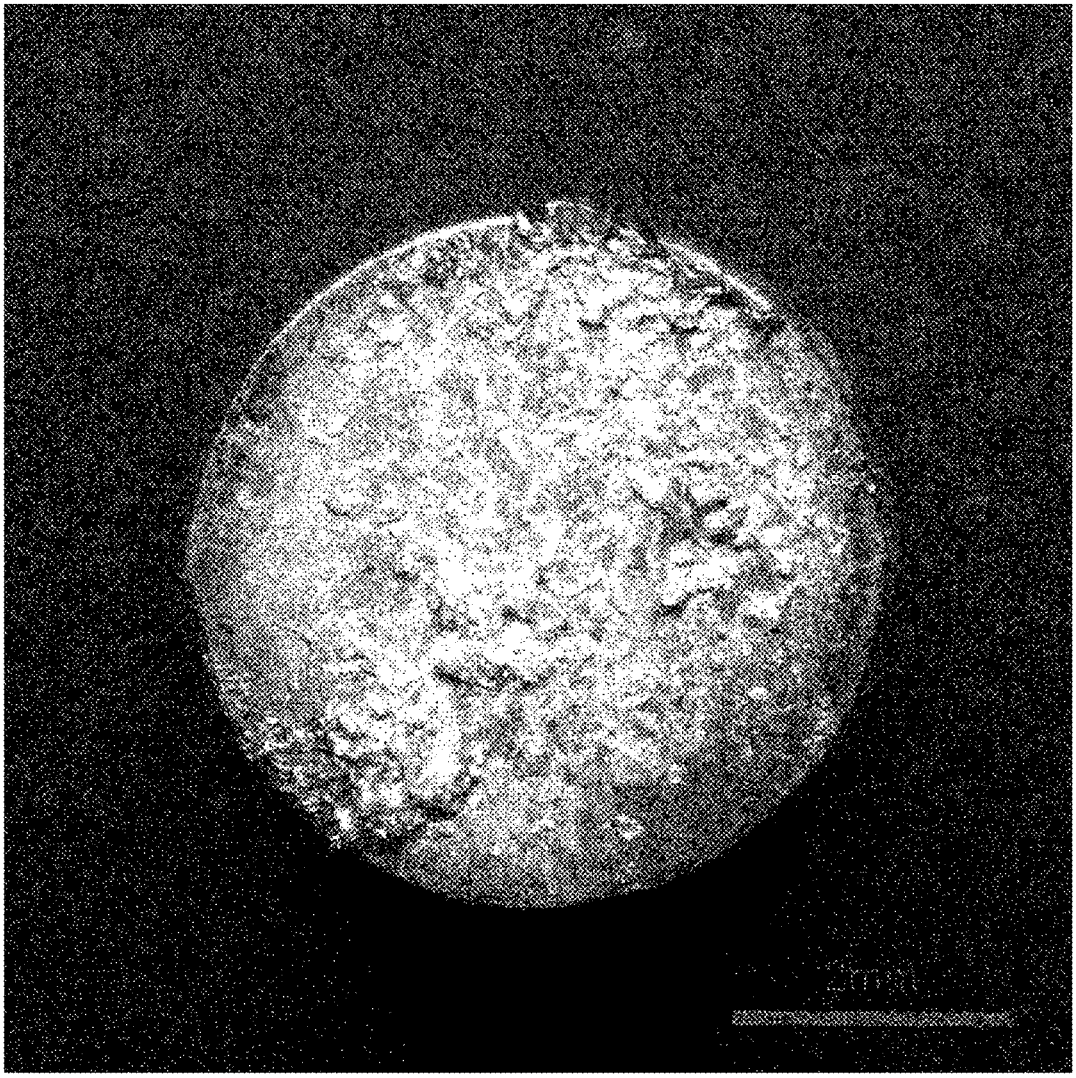

[FIG. 11]
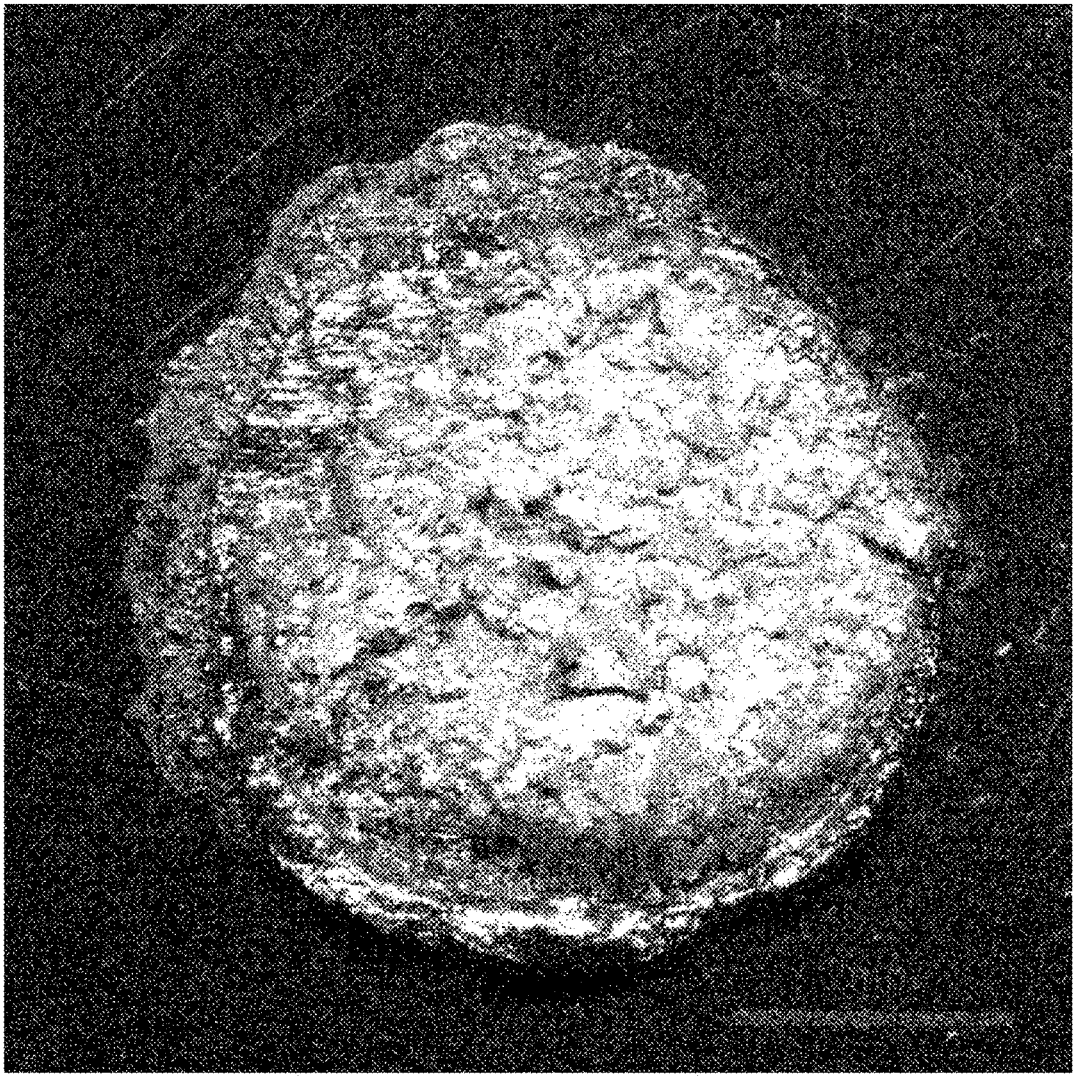

[FIG. 12]
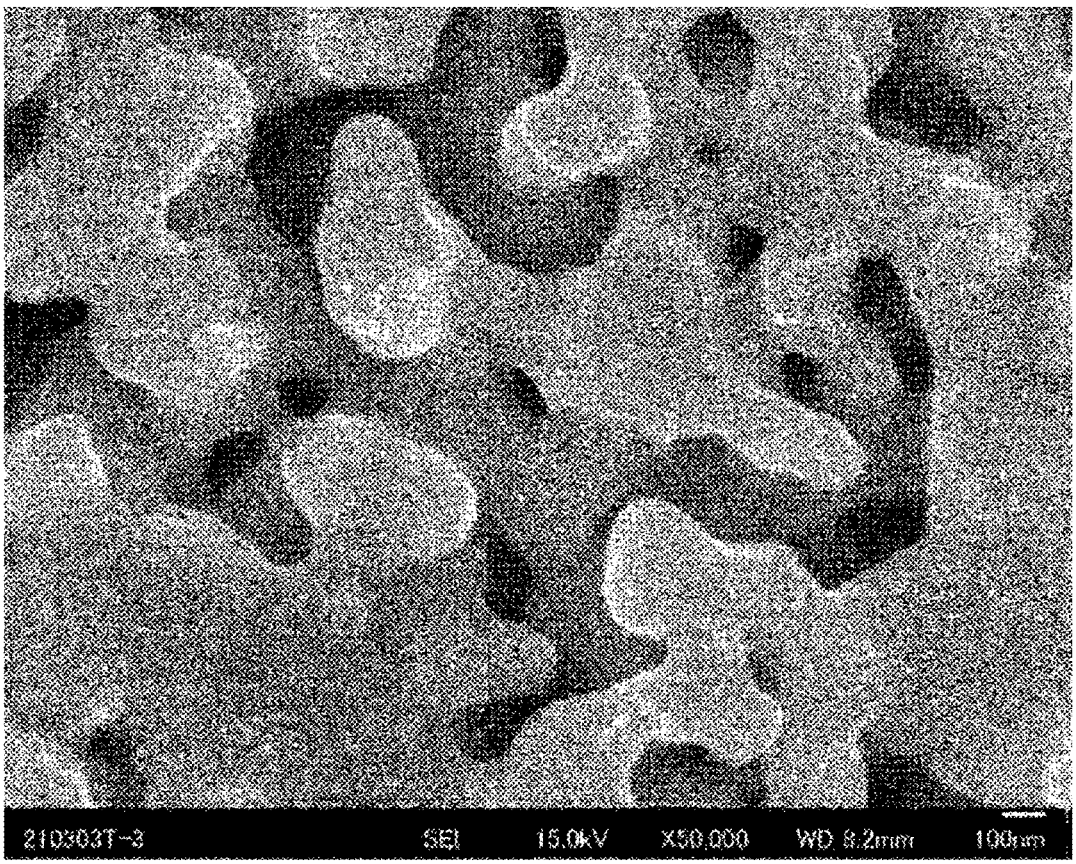

[FIG. 13]
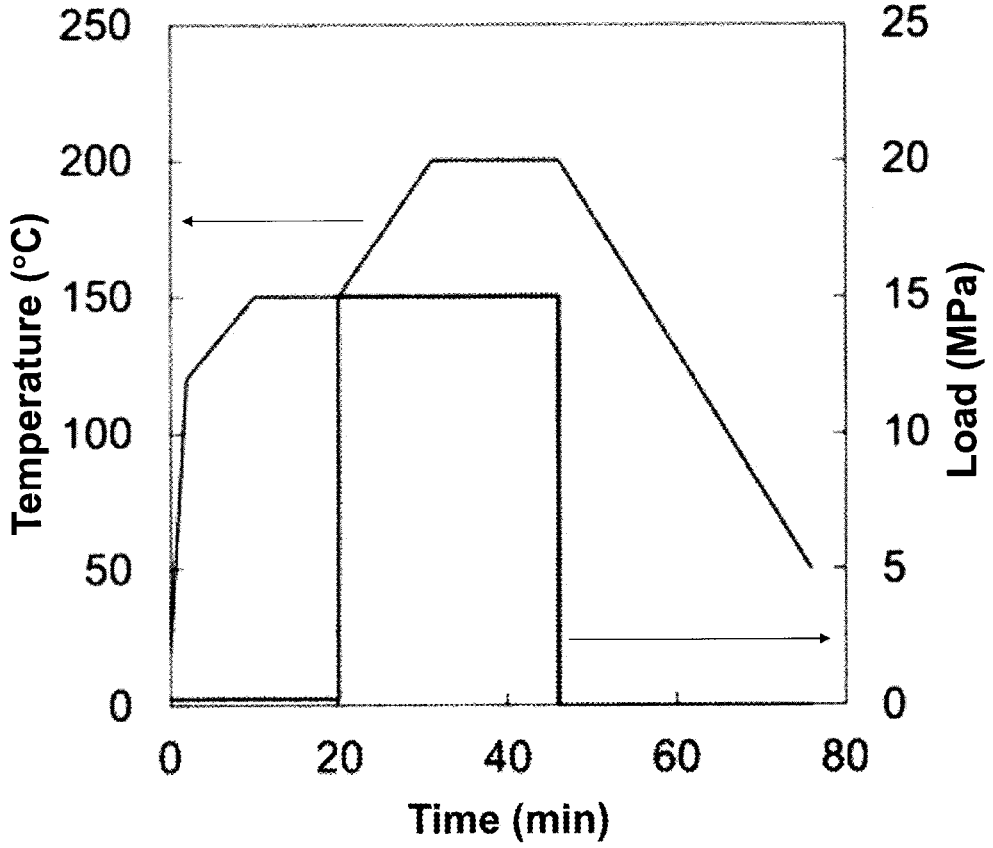

[FIG. 14]
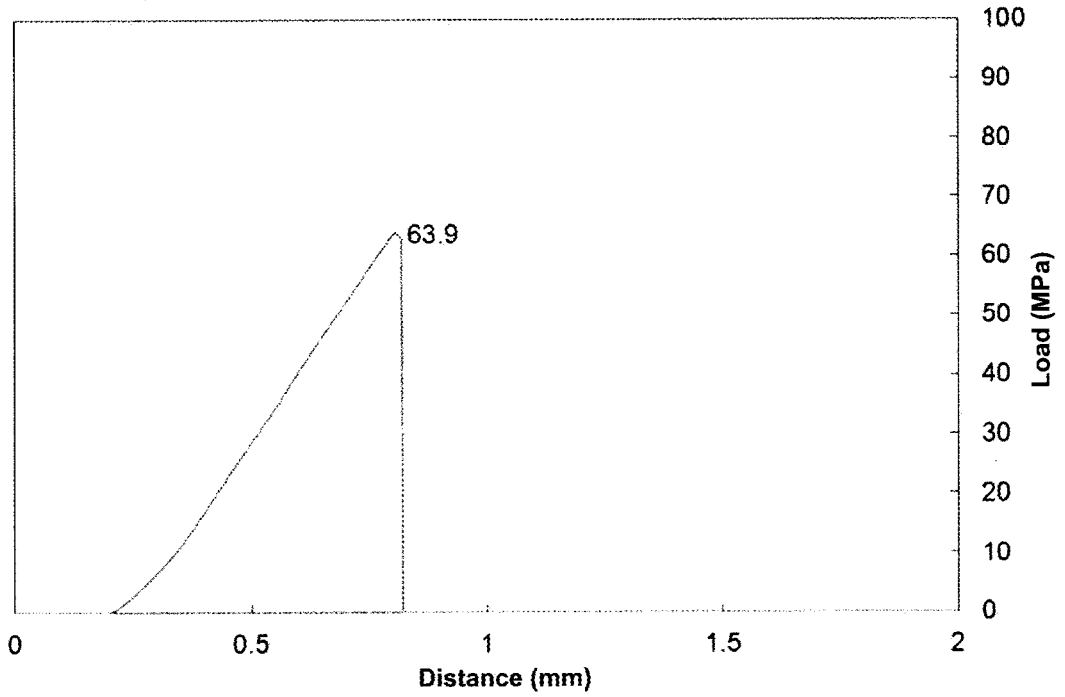

[FIG. 15]
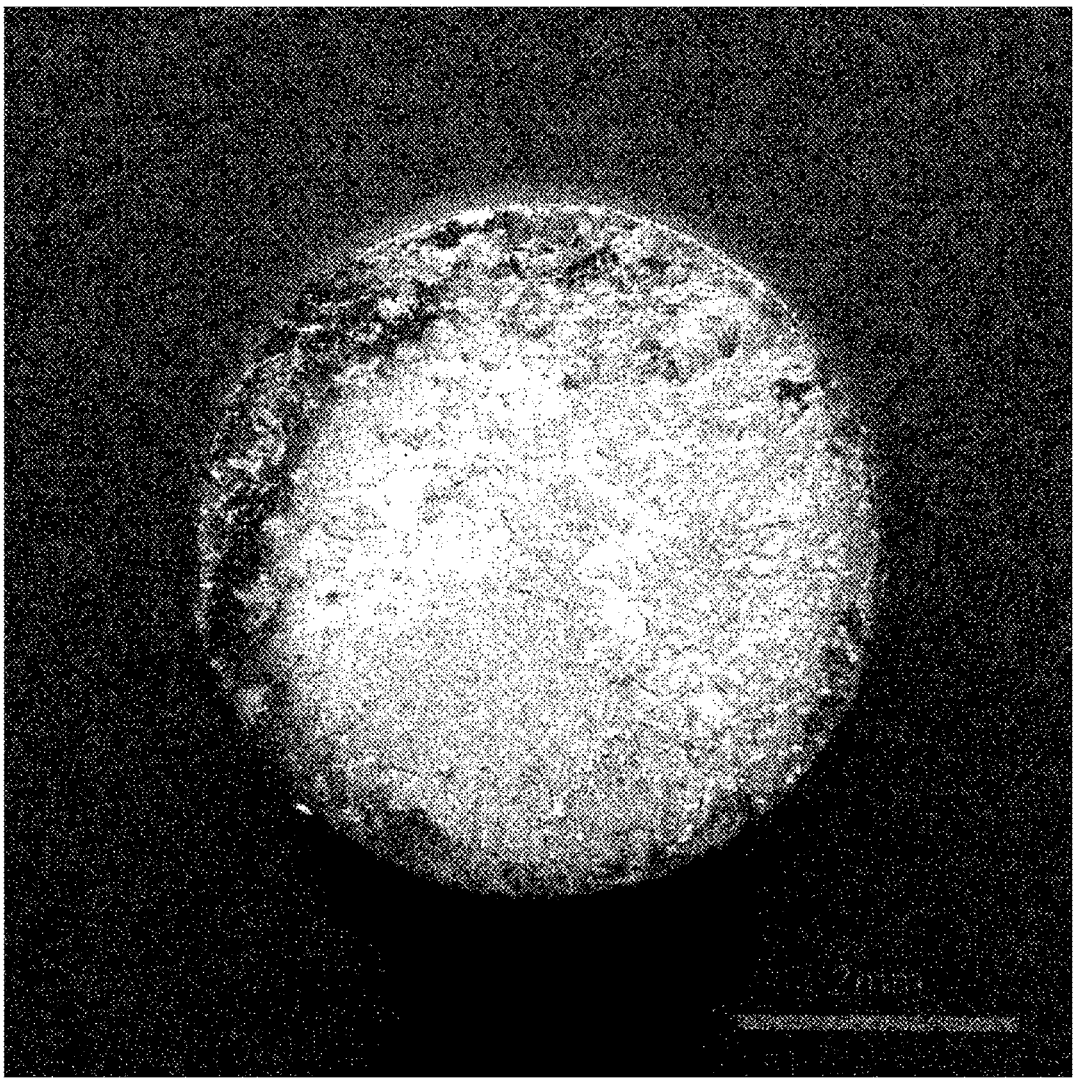

[FIG. 16]
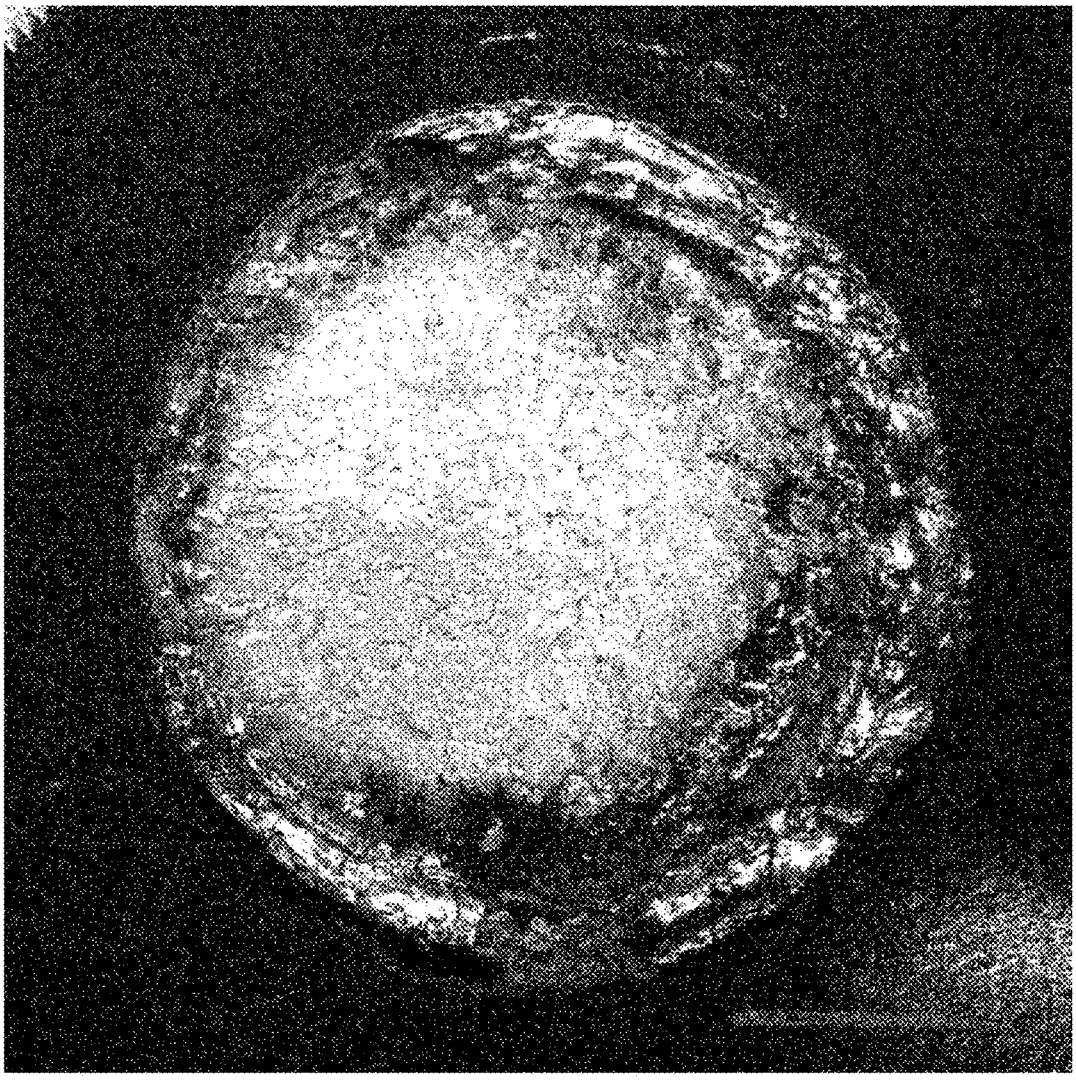

[FIG. 17]
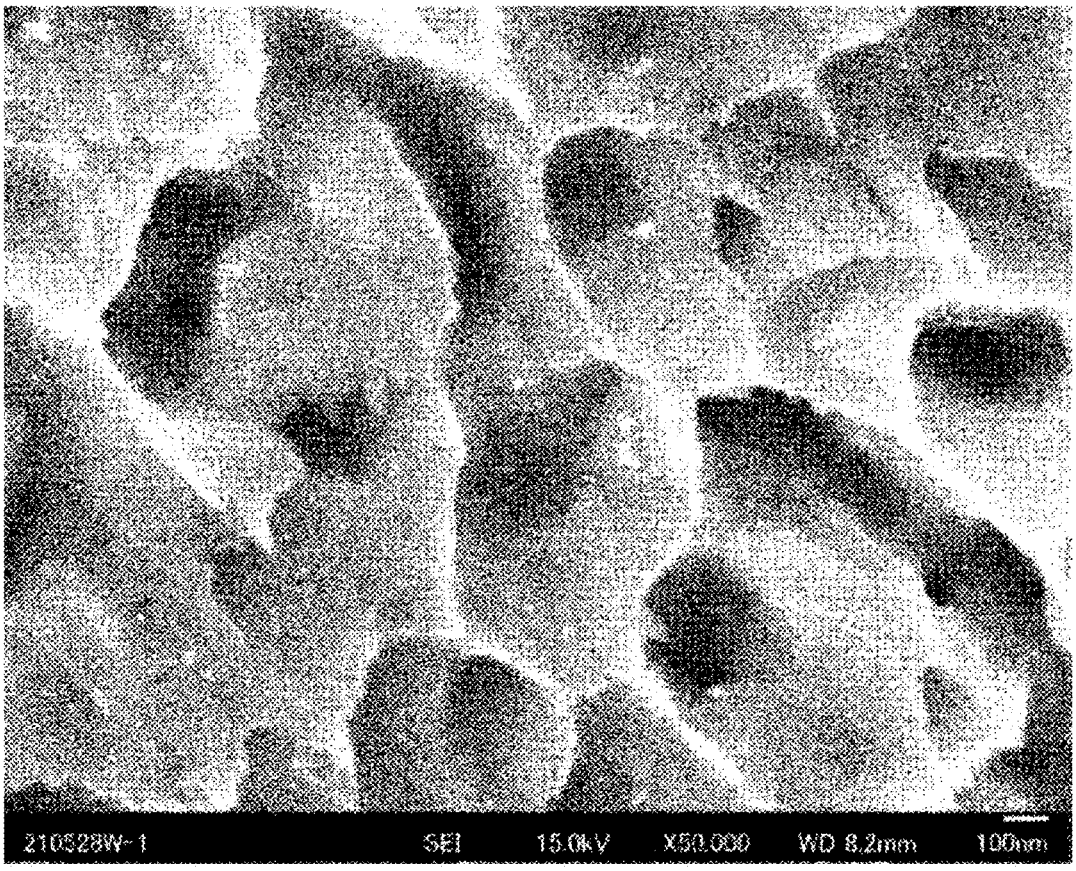

OXIDE-CONTAINING COPPER FINE PARTICLES, METHOD FOR PRODUCING SAME, AND METHOD FOR PRODUCING SINTERED COMPACT USING OXIDE-CONTAINING COPPER FINE PARTICLES

TECHNICAL FIELD

The present disclosure relates to oxide-containing copper fine particles, a method for producing the same, and a method for producing a sintered compact using the oxide-containing copper fine particles.

BACKGROUND ART

In recent years, in the manufacture of printed circuit boards, as a clean technique that requires neither exposure to light nor etching, which have been conventionally used, and that does not emit harmful chemical substances, a technique called printable electronics that directly forms fine wiring by inkjet or printing has attracted attention.

The fine wiring is mainly obtained by heating and sintering metal fine particles. The metal fine particles are required to be sintered at a temperature 250 to lower than 350° C., for example, from the viewpoint of heat resistance of a substrate or the like. At present, silver fine particles, which can be sintered at a low temperature, are often used, but silver fine particles are expensive and there is a concern about the influence of a wiring short circuit due to ion migration. As a substitute for silver fine particles, copper fine particles, which are inexpensive and have high resistance to ion migration, have attracted attention, but copper fine particles have a problem that it is difficult to sinter them at a low temperature, so that they have not been used practically.

On the other hand, the present inventors have made it possible to sinter copper fine particles at 200° C. or lower by any of two-steps heating (Patent Document 1), introduction of a copper complex ink (Patent Document 2), and incorporation of cuprous oxide ($Cu_2O$) into copper fine particles (Patent Document 3).

CONVENTIONAL ART DOCUMENT

Patent Document

Patent Document 1: JP 2015-214722 A
Patent Document 2: JP 2017-1978 A
Patent Document 3: WO 2019/106739

DISCLOSURE OF THE INVENTION

Problems to be Solved by the Invention

However, in Patent Document 1, two-steps heating (oxidation treatment and reduction treatment) is required, whereas in Patent Document 2, it is necessary to prepare, in addition to copper fine particles (copper powder), an additional copper material (copper complex). In both the cases, many steps are required. In Patent Document 3, it is necessary to perform sintering under high vacuum, and batch processing is required for taking in and out of a vacuum facility, so that productivity is lowered.

The present invention has been made in view of such a situation, and an object thereof is to provide copper fine particles from which a sintered compact that exhibits sufficient conductivity can be obtained by one-step heating at 200° C. or lower under normal pressure (or a pressure not lower than normal pressure) without requiring two-steps heating or an additional copper material, a method for producing the copper fine particles, and a method for producing a sintered compact using the copper fine particles.

Means for Solving the Problems

An aspect 1 of the present invention is directed to oxide-containing copper fine particles including $Cu_{64}O$ and optionally $Cu_2O$ and coated with a carboxylic acid, wherein a mass ratio of $Cu_{64}O$ to a total mass of Cu, $Cu_{64}O$ and $Cu_2O$ is 0.5 to 2.0% by mass.

An aspect 2 of the present invention is directed to
the oxide-containing copper fine particles according to the aspect 1, wherein a mass ratio of $Cu_2O$ to the total mass of Cu, $Cu_{64}O$ and $Cu_2O$ is 0% by mass or more and less than 0.5% by mass.

An aspect 3 of the present invention is directed to
the oxide-containing copper fine particles according to the aspect 1, wherein a mass ratio of $Cu_2O$ to the total mass of Cu, $Cu_{64}O$ and $Cu_2O$ is 0.5 to 2.0% by mass.

An aspect 4 of the present invention is directed to
a method for producing the oxide-containing copper fine particles according to any one of the aspects 1 to 3, wherein the method includes:
preparing copper fine particles;
coating the copper fine particles with a carboxylic acid; and
adding the copper fine particles coated with the carboxylic acid to a dispersing medium and dispersing the copper fine particles by using a bead mill or a high-pressure wet type atomizer.

An aspect 5 of the present invention is directed to
the method according to the aspect 4, wherein the dispersing is performed under an inert gas atmosphere.

An aspect 6 of the present invention is directed to
the method according to the aspect 4, wherein the dispersing is performed under a normal air atmosphere.

An aspect 7 of the present invention is directed to
the method according to any one of the aspects 4 to 6, wherein a rotation speed of an agitator of the bead mill is 1000 rpm or more and less than 3000 rpm.

An aspect 8 of the present invention is directed to
a method for producing a copper fine particle sintered compact, wherein the method includes heating the oxide-containing copper fine particles according to any one of the aspects 1 to 3 to 100° C. to 200° C. under an inert gas atmosphere.

An aspect 9 of the present invention is directed to
the method according to the aspect 8, wherein the inert gas includes $N_2$.

An aspect 10 of the present invention is directed to
the method according to the aspect 9, wherein the inert gas is mixed with less than 4% by volume of $H_2$.

Technical Effects of the Invention

According to embodiments of the present invention, it is possible to provide copper fine particles from which a sintered compact that exhibits sufficient conductivity can be obtained by one-step heating at 200° C. or lower under normal pressure (or a pressure not lower than normal pressure) without requiring two-steps heating or an additional copper material, a method for producing the copper fine particles, and a method for producing a sintered compact using the copper fine particles.

BRIEF DESCRIPTION OF THE DRAWINGS

FIG. 1 is an XRD pattern of oxide-containing copper fine particles of Sample No. 1.

FIG. 2 is an XRD pattern of oxide-containing copper fine particles of Sample No. 2.

FIG. 3 is a high-resolution TEM image of the oxide-containing copper fine particles of Sample No. 1.

FIG. 4 is a high-resolution TEM image of the oxide-containing copper fine particles of Sample No. 2.

FIG. 5 is a SEM image of a sintered compact after heating the oxide-containing copper fine particles of Sample No. 1 to 120° C. under normal pressure and an atmosphere of a mixed gas (hydrogen concentration: 3% by volume) which consists of nitrogen having a purity of 4N and hydrogen.

FIG. 6 is a SEM image of a sintered compact after heating the oxide-containing copper fine particles of Sample No. 1 to 200° C. under normal pressure and an atmosphere of a mixed gas (hydrogen concentration: 3% by volume) which consists of nitrogen having a purity of 4N and hydrogen.

FIG. 7 is a profile of temperature and pressure when a cylindrical copper test piece 1 and a cylindrical copper test piece 2 were bonded together using oxide-containing copper fine particles of Sample No. 3 without pressurization.

FIG. 8 is a schematic diagram for explaining a method for measuring bonding strength when the cylindrical copper test piece 1 and the cylindrical copper test piece 2 were bonded together using the oxide-containing copper fine particles of Sample No. 3.

FIG. 9 is a graph showing a result of bonding strength measurement when the cylindrical copper test piece 1 and the cylindrical copper test piece 2 were bonded together using the oxide-containing copper fine particles of Sample No. 3 without pressurization.

FIG. 10 is an optical microscopic image of a fracture surface on the cylindrical copper test piece 1 side after the bonding strength measurement in FIG. 9.

FIG. 11 is an optical microscopic image of a fracture surface on the cylindrical copper test piece 2 side after the bonding strength measurement in FIG. 9.

FIG. 12 is a FE-SEM image of a fracture surface on the cylindrical copper test piece 2 side after the bonding strength measurement in FIG. 9.

FIG. 13 is a profile of temperature and pressure when the cylindrical copper test piece 1 and the cylindrical copper test piece 2 were bonded together using the oxide-containing copper fine particles of Sample No. 3 with pressurization.

FIG. 14 is a graph showing a result of bonding strength measurement when the cylindrical copper test piece 1 and the cylindrical copper test piece 2 were bonded together using the oxide-containing copper fine particles of Sample No. 3 with pressurization.

FIG. 15 is an optical microscopic image of a fracture surface on the cylindrical copper test piece 1 side after the bonding strength measurement in FIG. 14.

FIG. 16 is an optical microscopic image of a fracture surface on the cylindrical copper test piece 2 side after the bonding strength measurement in FIG. 14.

FIG. 17 is a FE-SEM image of a fracture surface on the cylindrical copper test piece 2 side after the bonding strength measurement in FIG. 14.

MODE FOR CARRYING OUT THE INVENTION

The inventors of the present application have studied from various angles in order to obtain copper fine particles from which a sintered compact that exhibits sufficient conductivity can be obtained by one-step heating at 200° C. or lower under normal pressure (or a pressure not lower than normal pressure) without requiring two-steps heating or an additional copper material.

As a result, they have found that by incorporating $Cu_{64}O$ at a specific mass ratio into copper fine particles and coating the copper fine particles with a carboxylic acid, the $Cu_{64}O$ is reduced by a fluxing action of the carboxylic acid at the time of heating at 200° C. or lower under normal pressure (or a pressure not lower than normal pressure) and the copper fine particles are facilitated to bond together (necking). As a result, a sintered compact that exhibits sufficient conductivity could be successfully obtained by one-step heating at 200° C. or lower under normal pressure (or a pressure not lower than normal pressure) without requiring two-steps heating or an additional copper material as required in the conventional art.

DETAILS OF THE RESPECTIVE REQUIREMENTS SPECIFIED BY THE EMBODIMENTS OF THE PRESENT INVENTION WILL BE ILLUSTRATED BELOW

The oxide-containing copper fine particles according to the embodiments of the present invention include $Cu_{64}O$ and optionally $Cu_2O$ and are coated with a carboxylic acid, wherein a mass ratio of $Cu_{64}O$ to a total mass of Cu, $Cu_{64}O$ and $Cu_2O$ is 0.5 to 2.0% by mass. That is, the oxide-containing copper fine particles may not contain $Cu_2O$, and in this case, it is just required to set the mass ratio of $Cu_{64}O$ to the total mass of Cu and $Cu_{64}O$ to 0.5 to 2.0% by mass. On the other hand, the oxide-containing copper fine particles may contain $Cu_2O$, and in this case, it is just required to set the mass ratio of $Cu_{64}O$ to the total mass of Cu, $Cu_{64}O$ and $Cu_2O$ to 0.5 to 2.0% by mass.

When the mass ratio of $Cu_{64}O$ to the total mass of Cu, $Cu_{64}O$ and $Cu_2O$ is less than 0.5% by mass, diffusion of copper atoms during heating is suppressed due to an insufficient amount of $Cu_{64}O$ and a bonding action between copper fine particles is weakened, so that the conductivity of a sintered compact obtained by one-step heating at 200° C. or lower under normal pressure (or a pressure not lower than normal pressure) may be insufficient. Therefore, the mass ratio of $Cu_{64}O$ to the total mass of Cu, $Cu_{64}O$ and $Cu_2O$ is set to 0.5% by mass or more, preferably 1.0% by mass or more. On the other hand, when the mass ratio of $Cu_{64}O$ to the total mass of Cu, $Cu_{64}O$ and $Cu_2O$ is more than 2.0% by mass, the amount of $Cu_{64}O$ is excessive, and $Cu_{64}O$ cannot be sufficiently reduced by one-step heating at 200° C. or lower under normal pressure (or a pressure not lower than normal pressure), so that the conductivity of a resulting sintered compact may be insufficient.

The oxide-containing copper fine particles according to the embodiments of the present invention optionally include $Cu_2O$. $Cu_2O$ is less likely to be reduced by the fluxing action of a carboxylic acid as compared with $Cu_{64}O$, but at least part of $Cu_2O$ can be reduced at a relatively high temperature of 180° C. or higher, preferably 200° C. or higher, under normal pressure (or a pressure not lower than normal pressure). Therefore, by setting the mass ratio of $Cu_{64}O$ to the total mass of Cu, $Cu_{64}O$ and $Cu_2O$ to 0.5 to 2.0% by mass and further containing $Cu_2O$, the necking of copper fine particles with each other is promoted by heating the copper fine particles at a relatively high temperature, so that it becomes possible to improve the conductivity of a resulting sintered compact.

One preferred embodiment of the present invention is to set the mass ratio of $Cu_2O$ to the total mass of Cu, $Cu_{64}O$ and $Cu_2O$ to 0% by mass or more and less than 0.5% by mass. That is, $Cu_2O$ is not contained (the mass ratio of $Cu_2O$ to the total mass of Cu, $Cu_{64}O$ and $Cu_2O$ is set to 0% by mass), or alternatively, $Cu_2O$ is contained and the mass ratio of $Cu_{64}O$ to the total mass of Cu and $Cu_{64}O$ is set to more than 0% by mass and less than 0.5% by mass. This makes it possible to obtain a sintered compact that exhibits sufficient conductivity even by heating at a lower temperature (for example, 120° C. or lower).

Another preferred embodiment of the present invention is to set the mass ratio of $Cu_2O$ to the total mass of Cu, $Cu_{64}O$ and $Cu_2O$ to 0.5 to 2.0% by mass. This makes it possible to obtain a sintered compact having higher conductivity by heating at a high temperature of, for example, 180° C. or higher, or 200° C. or higher.

In the oxide-containing copper fine particles according to the embodiments of the present invention, the mass ratios of $Cu_{64}O$ and $Cu_2O$ to the total mass of Cu, $Cu_{64}O$ and $Cu_2O$ can be determined by acquiring an XRD pattern and calculating the ratios using a Reference Intensity Ratio (RIR) method. The RIR method is a method of calculating a quantitative value from an integrated intensity obtained by subtracting a background intensity determined by drawing a baseline at the strongest line of a component to be examined, using an RIR value specified in the database. In the embodiments of the present invention, the mass ratio was calculated using the integrated intensities of the strongest lines of the respective components (Cu(111), $Cu_{64}O$(044) and $Cu_2O$ (111)) and the respective RIR values (Cu: 8.86, $Cu_{64}O$: 4.89, $Cu_2O$: 8.28). In addition, Cu(111), $Cu_{64}O$ (044) and $Cu_2O$ (111) have diffraction peaks at the positions of $2\theta=43.298°$, $2\theta=40.710°$, and $2\theta=36.419°$, respectively.

One preferred embodiment of the present invention is that the oxide-containing copper fine particles are composed of Cu, $Cu_{64}O$ and inevitable impurities, the mass ratio of $Cu_{64}O$ to the total mass of Cu and $Cu_{64}O$ is 0.5 to 2.0% by mass, and the oxide-containing copper fine particles are coated with a carboxylic acid. The content of the inevitable impurities is preferably 2.0% by mass or less, and more preferably 1.0% by mass or less. These make it possible to improve the conductivity of a sintered compact. Another preferred embodiment of the present invention is such that the oxide-containing copper fine particles are composed of Cu, $Cu_{64}O$, $Cu_2O$ and inevitable impurities, the mass ratio of $Cu_{64}O$ to the total mass of Cu, $Cu_{64}O$ and $Cu_2O$ is 0.5 to 2.0% by mass, the mass ratio of $Cu_2O$ to the total mass of Cu, $Cu_{64}O$ and $Cu_2O$ is more than 0% by mass and less than 0.5% by mass, and the oxide-containing copper fine particles are coated with a carboxylic acid. A still another preferred embodiment of the present invention is such that the oxide-containing copper fine particles are composed of Cu, $Cu_{64}O$, $Cu_2O$ and inevitable impurities, the mass ratio of $Cu_{64}O$ to the total mass of Cu, $Cu_{64}O$ and $Cu_2O$ is 0.5 to 2.0% by mass, the mass ratio of $Cu_2O$ to the total mass of Cu, $Cu_{64}O$ and $Cu_2O$ is 0.5 to 2.0% by mass, and the oxide-containing copper fine particles are coated with a carboxylic acid. The content of the inevitable impurities is preferably 2.0% by mass or less, and more preferably 1.0% by mass or less. These make it possible to improve the conductivity of a sintered compact.

The inevitable impurities refer to elements which may be mixed into depending on the conditions of raw materials, materials, manufacturing facilities and the like.

In the embodiments of the present invention, $Cu_{64}O$ is preferably present on a surface of the oxide-containing copper fine particles. That is, it is preferable that $Cu_{64}O$ is present on the surface of the oxide-containing copper fine particles and the surface is coated with a carboxylic acid. This makes it possible to promote the necking of copper fine particles with each other especially when the copper fine particles are heated at a low temperature (for example, 120° C. or lower). At that time, it is preferable that the oxide-containing copper fine particles includes a portion in which the thickness of $Cu_{64}O$ present on the surface of the oxide-containing copper fine particles from the surface is 5 nm or less. This makes it easy to reduce $Cu_{64}O$ by the fluxing action of a carboxylic acid especially when the copper fine particles are heated at a low temperature (for example, 120° C. or lower). The lower limit of the thickness of $Cu_{64}O$ from the surface is not particularly limited, but may be, for example, 0.1 nm or more.

In the embodiment of the present invention, whether or not $Cu_{64}O$ is present on the surface of the oxide-containing copper fine particles can be checked from a high-resolution TEM image including the periphery of an oxide-containing copper fine particle as shown in FIGS. 3 and 4. That is, since the lattice fringe spacings (plane spacings) of the Cu(111) plane, the $Cu_{64}O$ (044) plane, and the $Cu_2O$(111) plane having high diffraction intensities are 2.088 Å, 2.215 Å, and 2.465 Å, respectively, Cu, $Cu_{64}O$ and $Cu_2O$ are distinguishable from each other based on the difference in lattice fringe spacing thereof in the high-resolution TEM image, and it is possible to check whether or not $Cu_{64}O$ is present at the periphery (surface) of an oxide-containing copper fine particle.

The average particle diameter of the oxide-containing copper fine particles according to the embodiments of the present invention is preferably 20 to 300 nm. Here, the "particle diameter" refers to a primary particle diameter and an equivalent circle diameter of the oxide-containing copper fine particles, and the "average particle diameter" refers to a median diameter. When the average particle diameter is adequately large, the cohesive force between the fine particles is reduced. In this case, for example, when oxide-containing copper fine particles are dispersed in a dispersing medium, the fine particles are easily dispersed. In addition, when the average particle diameter is adequately large, the surface area as a whole can be reduced, so that the coating amount of the carboxylic acid, which is an insulator, can also be reduced, and the conductivity of the sintered compact can be easily improved. Furthermore, since the surface area can be reduced as a whole, excessive surface oxidation can also be suppressed. On the other hand, when the average particle diameter is adequately small, the sintered compact having a uniform surface is easily obtained, and not only the volume resistivity of the sintered compact is reduced, but also higher-speed transmission is achieved. This phenomenon is attributed to a skin effect. That is, since current concentration occurs on a conductor surface in a case of high-frequency signals, if the surface of the sintered compact is rough, the transmission path is extended and the loss increases. By reducing the average particle diameter of the copper fine particles constituting the sintered compact, the surface roughness is reduced, and the uniformity of the sintered compact is easily obtained.

The average particle diameter can be determined by randomly imaging at least 10 or more oxide-containing copper fine particles using a scanning electron microscope (SEM) and measuring the particle diameters thereof.

The shape of the oxide-containing copper fine particles according to the embodiment of the present invention is not particularly limited, and may be a spherical shape, an ellipsoidal shape, a polygonal shape (a multiangular pyramidal shape, a cubic shape, a rectangular parallelepiped shape, and the like), a plate shape, a rod shape, and/or an irregular shape. From the viewpoint of being superior in dispersibility, it is preferable that the oxide-containing copper fine particles have an isotropic shape such as a spherical shape.

In the embodiments of the present invention, $Cu_{64}O$ and, in some cases, $Cu_2O$ are reduced by utilizing a fluxing action of a carboxylic acid during heating. Examples of the carboxylic acid for coating the oxide-containing copper fine particles according to the embodiments of the present invention include saturated fatty acids, unsaturated fatty acids, hydroxy acids, aromatic carboxylic acids, and terpene-based carboxylic acids, etc. These may be used singly or two or more thereof may be used in combination. As the carboxylic acid, it is preferable to use at least one compound selected from aliphatic monocarboxylic acids, aliphatic dicarboxylic acids, aromatic carboxylic acids, and terpene-based carboxylic acids. The carboxylic acid is preferably hydrophobic. The hydrophobicity enables the oxide-containing copper fine particles to suppress an equilibrium reaction represented by the following formula (1) during storage (during non-heating) and to suppress the progress of a corrosion reaction caused by $H_3O^+$.

$$RCOOH+H_2O \Leftrightarrow RCOO^-+H_3O^+ \quad (1)$$

In the above formula (1), R is, for example, a monovalent hydrocarbon group.

The aliphatic monocarboxylic acid preferably has 5 or more carbon atoms because it exhibits hydrophobicity. The aliphatic monocarboxylic acid may be either linear or branched, and may be either a saturated aliphatic monocarboxylic acid or an unsaturated aliphatic monocarboxylic acid. Among them, a linear saturated aliphatic monocarboxylic acid is preferable. The number of the carbon atoms of the aliphatic monocarboxylic acid is preferably 5 to 18. The aliphatic monocarboxylic acid may be used singly or two or more types thereof may be used in combination. As the aliphatic monocarboxylic acid, those having an even number of carbon atoms, such as caproic acid (6 carbon atoms), caprylic acid (8 carbon atoms), capric acid (10 carbon atoms), lauric acid (12 carbon atoms), myristic acid (14 carbon atoms), palmitic acid (16 carbon atoms), and stearic acid (18 carbon atoms), are inexpensive and easily available, and thus suitable.

The aliphatic dicarboxylic acid preferably has 6 or more carbon atoms because it exhibits hydrophobicity. The aliphatic dicarboxylic acid may be either linear or branched, and may be either a saturated aliphatic dicarboxylic acid or an unsaturated aliphatic dicarboxylic acid. Among these, a linear saturated aliphatic dicarboxylic acid is preferred. The aliphatic dicarboxylic acid preferably has 6 to 18 carbon atoms. Aliphatic dicarboxylic acids may be used singly or two or more thereof may be used in combination. Examples of the aliphatic dicarboxylic acid include adipic acid, pimelic acid, suberic acid, azelaic acid, sebacic acid, 1,0-nonane dicarboxylic acid, 1,10-decane dicarboxylic acid, brasylic acid, 1,12-dodecane dicarboxylic acid, 1,13-tridecane dicarboxylic acid, thapsic acid, 1,15-pentadecane dicarboxylic acid, and 1,16-hexadecane dicarboxylic acid.

Examples of the aromatic carboxylic acid include benzoic acid, phthalic acid, isophthalic acid, terephthalic acid, hemimellitic acid, trimellitic acid, and trimesic acid.

As a terpene-based carboxylic acid, one contained in rosin and the like can be used. Examples thereof include abietic acid, neoabietic acid, parastrinic acid, pimaric acid, isopimaric acid, and desidroabietic acid.

In the embodiments of the present invention, whether or not oxide-containing copper fine particles are coated with a carboxylic acid can be checked by a publicly known mass spectrometric method, for example, by ionizing a carboxylic acid on a surface by laser desorption ionization (LDI) or the like and then determining a mass-to-charge ratio by time of flight (TOF) measurement or the like.

The method for producing oxide-containing copper fine particles according to the embodiments of the present invention includes: preparing copper fine particles; coating the copper fine particles with a carboxylic acid; and adding the copper fine particles coated with the carboxylic acid to a dispersing medium and dispersing the copper fine particles by using a bead mill or a high-pressure wet type atomizer.

In the following, the respective steps are described in detail.

<1. Preparing Copper Fine Particles>

The method for preparing copper fine particles is not particularly limited, and examples thereof include a gas phase method (such as a sputtering method, an evaporation method, or a plasma method) and a liquid phase method (such as a chemical reduction method, a heating decomposition method, or a polyol method). The purity of the copper fine particles is preferably 98.0% by mass or more, and more preferably 99.0% by mass or more. This makes it possible to improve the conductivity of the sintered compact. The average particle diameter of the copper fine particles is preferably adjusted to 20 to 300 nm. The preparation of copper fine particles by a chemical reduction method is preferable because by dispersing or dissolving a copper compound in a solvent, adding a reducing agent and a carboxylic acid to the solvent, and then performing a reduction reaction of the copper compound, the step of coating with the carboxylic acid to be described later can be performed simultaneously.

<2. Coating with Carboxylic Acid>

By mixing the copper fine particles with a carboxylic acid, the copper fine particles can be coated with the carboxylic acid. At the time of the mixing, if the carboxylic acid is liquid, copper fine particles may be added to the carboxylic acid and mixed. And if the carboxylic acid is solid, the carboxylic acid may be dissolved in an appropriate solvent, followed by adding and mixing the copper fine particles. The temperature at the time of the mixing is preferably set to 25 to 90° C., and the mixing time is preferably set to 10 to 180 minutes.

Examples of the <1. Preparing copper fine particles> and the <2. Coating with carboxylic acid> according to the embodiments of the present invention will be described below.

First, a copper compound is dispersed or dissolved in a solvent, a carboxylic acid and a reducing agent are then added to the solvent, and the resulting mixture is reacted under conditions where a reduction reaction proceeds, such as heated conditions. Thus, copper fine particles coated with the carboxylic acid are produced.

As the solvent, lower alcohols having lower polarity than water such as methanol, ethanol, and 2-propanol, and ketones such as acetone can be used. These may be used singly or two or more thereof may be used in combination.

As the copper compound, copper oxide (CuO), cuprous oxide ($Cu_2O$), copper hydroxide ($Cu(OH)_2$), and the like, which disperse as particles in a solvent, or anhydrides or hydrates of copper formate ($Cu(HCOO)_2$), copper acetate ($Cu(CH_3COO)_2$), copper sulfate ($CuSO_4$), and the like, which partially or entirely dissolve in a solvent to form a copper ion solution, can be used.

The addition amount of the copper compound depends on the type of the copper compound and is not particularly limited, but from the viewpoint of, for example, the productivity of copper fine particles and suppression of an increase in viscosity of a reaction liquid, the copper compound is preferably added such that the concentration of copper ions is 0.01 to 5 mol/L, and more preferably 0.1 to 3 mol/L.

The addition amount of the carboxylic acid depends on the chain length thereof and the like, but from the viewpoint of controlling the coating amount for the copper fine particles, for example, it is preferably in the range of 0.0001 to 4 equivalents relative to the copper ions in the solvent, and more preferably in the range of 0.002 to 0.1 equivalents.

Examples of the reducing agent include hydrazine-based reducing agents such as hydrazine, hydrazine hydrochloride, hydrazine sulfate, and hydrazine hydrate, borohydride acid salt such as sodium borohydroxide, citric acid, and ascorbic acids, or the like. The addition amount of the reducing agent may be stoichiometrically determined in consideration of the reaction with the copper compound.

By heating a solvent in which a copper compound is dispersed or dissolved, metal nuclei of copper fine particles are reduced from the copper compound, and copper fine particles coated with the carboxylic acid are formed. The heating temperature is preferably set to 25 to 90° C., and the heating time is preferably set to 10 to 300 minutes.

After the completion of the reaction, the copper fine particles coated with the carboxylic acid are washed and purified with an organic solvent or the like, and then may be appropriately subjected to separation, drying, and the like.

<3. Dispersing by Using Bead Mill or High-Pressure Wet Type Atomizer>

The copper fine particles coated with the carboxylic acid formed as described above are added to a dispersing medium and then dispersed by using a bead mill or a high-pressure wet type atomizer. By this step, the copper fine particles can be adequately oxidized via the carboxylic acid and the dispersing medium in the process of being dispersed by using the bead mill or the high-pressure wet type atomizer, and as a result, $Cu_{64}O$ (and $Cu_2O$ in some cases) can be formed, and the mass ratio of $Cu_{64}O$ to the total mass of Cu, $Cu_4O$, and $Cu_2O$ can be adjusted to 0.5 to 2.0% by mass. The high-pressure wet type atomizer is a device that atomizes particles by extruding them from a plunger connected to an intensifier to a container filled with a liquid (a dispersing medium) at high pressure and colliding them with ceramic balls. Examples of the atomizer include Star Burst Mini (made by Sugino Machine Limited). The dispersion by using a high-pressure wet type atomizer is preferable because it will cause less contamination due to beads or the like during the dispersion as compared with dispersion by using a bead mill.

As the dispersing medium, an organic solvent is preferable from the viewpoint of being able to disperse the copper fine particles (and oxide-containing copper fine particles formed by the oxidation thereof) at a high concentration. Examples of the organic solvent include alcohol-based solvents such as alkanols, aliphatic polyhydric alcohols, and alicyclic alcohols, amine-based solvents, ester-based solvents such as acetic acid esters, ketone-based solvents such as chain ketones and cyclic ketones, ether-based solvents such as chain ethers and cyclic ethers, aromatic solvents such as aromatic hydrocarbons, halogen-based solvents such as haloalkanes, nitrile-based solvents, and nitro-based solvents. These may be used singly or two or more thereof may be used in combination. The viscosity of the dispersing medium is preferably 0.1 Pa·s or more because the dispersibility of the copper fine particles (and oxide-containing copper fine particles formed after the oxidation thereof) is improved.

The addition amount of the copper fine particles in the dispersing medium is, for example, preferably 30% by mass or more, and more preferably 50% by mass or more from the viewpoint of production efficiency. The upper limit of the addition amount is not particularly limited, but when it is assumed that the product is used as a coating liquid thereafter, it is preferably 90% by mass or less and more preferably 80% by mass or less from the viewpoint of applicability. In order to disperse the copper fine particles in the dispersing medium at an increased addition amount, the viscosity of the dispersing medium, the material (density) of the beads, the bead diameter (the number of beads), the rotation speed, and the like may be appropriately adjusted. Conditions (for example, the jetting pressure and the number of passes) in the case of using a high-pressure wet type atomizer may be appropriately adjusted according to the specification of the device to be used. For example, in the case of using Star Burst Mini (made by Sugino Machine Limited), the jetting pressure may be 100 to 245 MPa, and the number of passes is not particularly limited, but may be 1 to 20 passes from the viewpoint of productivity.

The dispersing medium may contain various additives, as necessary. Examples of the additives include coupling agents, dispersants, coloring agents, hue improvers, dye fixing agents, and gloss imparting agents.

The atmosphere during dispersion by using a bead mill may be an inert gas atmosphere or may be a normal air atmosphere. The pressure is not particularly limited. Dispersion in an inert gas atmosphere makes it possible to form oxide-containing copper fine particles that do not contain $Cu_2O$ or have a mass ratio of $Cu_2O$ to the total mass of Cu, $Cu_{64}O$, and $Cu_2O$ of less than 0.5% by mass. Examples of the inert gas include nitrogen, argon, and helium. As the purity of the inert gas is higher, oxide-containing copper fine particles containing less (or no) $Cu_2O$ can be formed. As the inert gas, $N_2$ is preferable from the viewpoint of being inexpensive and easily available, and for example, $N_2$ having a purity of 4N or more is more preferable. On the other hand, dispersion under the normal air atmosphere makes it possible to form oxide-containing copper fine particles having a mass ratio of $Cu_2O$ to the total mass of Cu, $Cu_{64}O$, and $Cu_2O$ of 0.5% by mass or more. Since the inside of a high-pressure wet type atomizer is filled with a liquid (a dispersing medium), the atmosphere during dispersion by using the high-pressure wet type atomizer is not particularly limited.

The temperature at the time of the dispersion by using a bead mill is preferably set to room temperature in order to suppress, for example, a reaction between the carboxylic acid and the dispersing medium. Dispersion may be performed while appropriately cooling such that the temperature does not become high due to the influence of friction between beads, collision with ceramic balls, and the like. Similarly, the dispersion by using a high-pressure wet type atomizer also may be performed while appropriately cooling such that the temperature does not become high due to the influence of collision with ceramic balls, and the like.

As the material of the beads of the bead mill, silica, alumina, zirconia, or the like can be used. Zirconia is preferably used from the viewpoint of high density, abrasion resistance, and the like. The bead diameter is not particularly limited, and may be appropriately adjusted according to other conditions such as the addition amount of copper fine particles, and may be set to, for example, 1 μm to 2 mm.

The rotation speed of the stirring member (agitator) of the bead mill is preferably less than 3,000 rpm in order to suppress excessive oxidation, deformation, fusion, integration, and excessive dispersion of copper fine particles. On the other hand, the rotation speed is preferably set to 1,000 rpm or more from the viewpoint of deagglomerating the copper fine particles to disperse the copper fine particles and adequately oxidizing the surface. In addition, the dispersion may be performed a plurality of times while changing the rotation speed. For example, the dispersion may be performed as follows: first, the rotation speed is set to 1,000 to 1,500 rpm, and when the dispersion has proceeded to some extent, the rotation speed is increased to 1,500 to 2,500 rpm and the dispersion is continued.

The dispersion time with a bead mill is not particularly limited, and may be appropriately adjusted according to other conditions such as the addition amount of copper fine particles, the dispersing medium, and the diameter of beads used in the bead mill. For example, the dispersion time may be set to 10 to 180 minutes.

After the completion of the dispersion by using the bead mill, the beads and the oxide-containing copper fine particles are separated using an appropriate separator. In the case of using a high-pressure wet type atomizer, unlike a bead mill, ceramic balls do not enter a dispersion liquid, and thus it is not necessary to separate ceramic balls and oxide-containing copper fine particles.

As described above, oxide-containing copper fine particles according to the embodiment of the present invention dispersed in a dispersing medium can be obtained. The dispersing medium may be removed by drying or the like, as necessary.

The method for producing oxide-containing copper fine particles according to the embodiments of the present invention may include other steps within the range that can meet the gist of the embodiments of the present invention.

As mentioned above, while the method for producing oxide-containing copper fine particles according to the embodiments of the present invention has been described above, a person skilled in the art who understands desired properties of the oxide-containing copper fine particles according to the embodiments of the present invention may take a process of trial and error to find a method of producing oxide-containing copper fine particles according to the embodiments of the present invention, other than the production method mentioned above.

The method for producing a copper fine particle sintered compact according to embodiments of the present invention includes heating the oxide-containing copper fine particles produced as described above to 100° C. to 200° C. under an inert gas atmosphere to sinter them. The "under an inert gas atmosphere" described above may be under normal pressure (or a pressure not lower than normal pressure) (namely, it may be normal pressure or may be in a state that the pressure is pressurized to more than normal pressure).

In the embodiments of the present invention, sintering may be performed under an inert gas atmosphere. The pressure of the atmosphere may be normal pressure (or a pressure not lower than normal pressure). Heating under the inert gas atmosphere has an advantage that unlike heating under vacuum, batch processing is not required and productivity is high. Examples of the inert gas include nitrogen, argon, and helium, and it is preferable that the inert gas includes nitrogen ($N_2$) from the viewpoint of being inexpensive and easily available, and it is more preferable that the inert gas is composed of $N_2$ having a high purity (for example, 4N or more). From the viewpoint of improving the conductivity of the sintered compact, a reducing gas such as hydrogen ($H_2$) may be mixed with the inert gas. $H_2$ may be mixed with the inert gas in a range less than the lower explosive limit (4% by volume), for example, not more than 3% by volume. Preferably, the inert gas is composed of $N_2$ having a high purity (for example, 4N or more) and $H_2$ is mixed with the inert gas in an amount of 3% by volume or less.

In the embodiments of the present invention, sintering can be performed at 200° C. or lower. From the viewpoint of the heat resistance of a substrate or the like, the lower the heating temperature is, the more preferable it is. On the other hand, from the viewpoint of productivity, the heating temperature is preferably set to 100° C. or higher, for example. The heating temperature is more preferably 120° C. or higher, and even more preferably 150° C. or higher. This can shorten the heating time. When the heat resistance of the substrate or the like is high depending on the application, the oxide-containing copper fine particles may be heated to higher than 200° C. from the viewpoint of improving the conductivity of the sintered compact.

In the embodiments of the present invention, the heating and sintering time is appropriately adjusted according to the heating temperature, the thickness of the sintered compact of copper fine particles, and the like, and may be set, for example, to 180 minutes or less. From the viewpoint of productivity, the heating and sintering time is preferably set to 120 minutes or less.

In the method for producing a copper fine particle sintered compact according to the embodiment of the present invention, the sintered compact may be produced by directly heating the oxide-containing copper fine particles according to the embodiment of the present invention, or the sintered compact may be produced by dispersing the fine particles in a dispersing medium and applying the dispersion liquid onto a substrate, and heating. The dispersing medium is preferably an organic solvent from the viewpoint of being able to disperse the oxide-containing copper fine particles at a high concentration. Examples of the organic solvent include alcohol-based solvents such as alkanols, aliphatic polyhydric alcohols, and alicyclic alcohols, amine-based solvents, ester-based solvents such as acetic acid esters, ketone-based solvents such as chain ketones and cyclic ketones, ether-based solvents such as chain ethers and cyclic ethers, aromatic solvents such as aromatic hydrocarbons, halogen-based solvents such as haloalkanes, nitrile-based solvents, and nitro-based solvents. These may be used singly or two or more thereof may be used in combination. Assuming that the dispersion liquid is used for screen printing, the dispersing medium may be a polyhydric alcohol having high viscosity such as ethylene glycol, propylene glycol, or glycerin. Assuming that the dispersion liquid is used for inkjet printing, the dispersing medium may be a lower alcohol having low viscosity such as methanol, ethanol, or 2-propanol. In addition, it is preferable to use the dispersing medium used in the method for producing oxide-containing copper fine particles according to the embodiments of the present invention as it is because the process can be simplified.

The dispersion liquid may contain various additives, as necessary. Examples of the additives include coupling agents, dispersants, coloring agents, hue improvers, dye fixing agents, and gloss imparting agents.

As the substrate, an organic material or an inorganic material can be used. Examples of the organic material include a polymethyl methacrylate-based resin, a polypropylene-based resin, a cyclic polyolefin-based resin, a styrene-based resin, a vinyl chloride-based resin, a polyester-based resin, a polyamide-based resin, a polycarbonate-based resin, a polysulfone-based resin, a polyethersulfone-based resin, a polyimide-based resin, a cellulose derivative, a fluororesin, a phenol resin, and an epoxy resin. Examples of the inorganic material include glasses such as soda glass, borosilicate glass, crown glass, barium-containing glass, strontium-containing glass, boron-containing glass, low alkali glass, alkali-free glass, crystallized transparent glass, silica glass, quartz glass, and heat-resistant glass, and a metal oxide such as alumina, sapphire, zirconia, titania, yttrium oxide, an indium oxide-tin oxide-based complex oxide (ITO), a fluorine-doped tin oxide (FTO), or an antimony-doped zinc oxide (AZO). These may be used singly or a composite material made of two or more of them in combination may be used. The thickness of the substrate is not particularly limited, but is preferably 5 mm or less in consideration of heat transfer and the like in the case of heating through the substrate.

As a method for applying the dispersion liquid, a conventional method can be used, but in the case of forming a pattern such as wiring, for example, a screen printing method, an inkjet printing method, an intaglio printing method, an offset printing method, an intaglio offset printing method, a letterpress printing method, a flexographic printing method, or reverse printing can be used. The wiring pattern can be formed, for example, by applying a dispersion liquid to a substrate so as to form a desired pattern and heating the dispersion liquid under the above-described conditions.

The applying amount is not particularly limited, but may be, for example, 1 to 100 g/m$^2$. The thickness of the sintered compact is not particularly limited, but may be, for example, 1 to 100 μm.

EXAMPLES

Examples of the present invention will be more specifically described by way of Examples. The embodiments of the present invention are not limited by the following Examples, and it is possible to implement the embodiments with modifications within the range that can meet the gist of the present disclosure as described above and below, all of these modifications being within the scope of the present disclosure.

A 0.1 mol of starting copper oxide (CuO, made by Nissin Chemco Ltd.) and 100 mL of a solvent alcohol (2-propanol or ethanol) were added into a 1 L flask. Then, caproic acid was added in a range of 2 to 6 mmol while sufficiently stirring the mixture with a stirring blade, and after the temperature was raised to 70° C. by a water bath, 0.2 mol of hydrazine monohydrate was added and the resulting mixture was reacted for 1 to 2 hours. After the reaction, the mixture was cooled to room temperature, and then a supernatant liquid was removed by centrifugation. Then, copper fine particles were purified by the same operation using a solvent such as ethanol, acetone, or methanol. Finally, the copper fine particles were sufficiently dried with a nitrogen flow, and a powder was collected. As a result of measuring the water contact angle of the obtained powder, high hydrophobicity was exhibited, and it was confirmed that surfaces of the fine particles were coated with caproic acid. In addition, as a result of taking an XRD pattern of the obtained powder and analyzing the purity of copper (Cu) by the RIR method, the purity was found to be 99.0% by mass or more.

The copper fine particles were added to a dispersing medium and dispersed by using a bead mill (made by Nippon Coke & Engineering Co., Ltd., product name: POWDER LAB). Dipropylene glycol was used as the dispersing medium, and the content of the copper fine particles was set to 50% by mass. The material of the beads was zirconia ($ZrO_2$), and the bead diameter was 0.03 mm. The dispersion was performed under a nitrogen atmosphere having a purity of 4N for Sample No. 1, and under a normal air atmosphere for Sample No. 2. The temperature was maintained at room temperature during the dispersion. The rotation speed of the agitator of the bead mill was initially set to 1,000 rpm and the dispersion was performed for 30 minutes, and then the dispersion was performed at 2,000 rpm for 30 minutes. After completion of the dispersion, the zirconia beads were separated with a separator, affording oxide-containing copper fine particles (Sample Nos. 1 and 2) dispersed in dipropylene glycol and coated with caproic acid.

The XRD patterns of the oxide-containing copper fine particles of Sample Nos. 1 and 2 were obtained. The XRD patterns were obtained by using sample substrates to which the dispersion liquids of the oxide-containing copper fine particles of Sample Nos. 1 and 2 were applied as it is. The XRD patterns of Sample Nos. 1 and 2 are shown in FIGS. 1 and 2, respectively. In FIGS. 1 and 2, only peaks attributable to Cu, $Cu_{64}O$ and $Cu_2O$ were observed. It can be said that the amount of inevitable impurities was 1.0% by mass or less.

The mass ratios of $Cu_{64}O$ and $Cu_2O$ to the total mass of Cu, $Cu_{64}O$ and $Cu_2O$ in each of Sample Nos. 1 and 2 were calculated using the RIR method. That is, the mass ratios were calculated using the integrated intensities at the strongest lines of respective components (Cu(111), $Cu_{64}O$ (044) and $Cu_2O$(111)) in FIGS. 1 and 2, and respective RIR values (Cu: 8.86, $Cu_{64}O$: 4.89, $Cu_2O$: 8.28). The integrated intensities were obtained by subtracting the background intensities determined by drawing the baselines and. Cu(111), $Cu_{64}O$ (044) and $Cu_2O$(111) have diffraction peaks at the positions of 2θ=43.298°, 2θ=40.710°, and 2θ=36.419°, respectively.

High-resolution TEM images of the peripheries of the oxide-containing copper fine particles of Sample Nos. 1 and 2 were taken. The TEM samples were obtained by diluting the dispersion liquids of the oxide-containing copper fine particles of Sample Nos. 1 and 2, applying the diluted dispersion liquids each onto a carbon coated grid for high-resolution TEM, followed by vacuum-drying. FIGS. 3 and 4 show high-resolution TEM images of Sample Nos. 1 and 2, respectively. In addition, in the earlier application (Japanese Patent Application No. 2020-144680) based on which the present application claims priory, regarding FIGS. 3 and 4, original figures were filed in the form of a submission of materials so that a difference in lattice fringes could be understood in more detail. Please refer to these original figures if necessary.

In FIGS. 3 and 4, each region denoted by "1" is a region in which lattice fringes corresponding to the plane spacing of Cu(111) are observed, each region denoted by "2" is a region in which lattice fringes corresponding to the plane spacing of $Cu_{64}O$(044) are observed, and each region denoted by 3 is a region in which lattice fringes corresponding to the plane spacing of $Cu_2O$(111) are observed. In FIGS. 3 and 4, it was confirmed that Cu, $Cu_{64}O$, and $Cu_2O$ were present in one particle.

Oxide-containing copper fine particles of Sample Nos. 1 and 2 dispersed in dipropylene glycol were applied onto an alumina substrate, and heated under normal pressure for 60 minutes under six conditions in total including two types of heating atmosphere (a nitrogen atmosphere having a purity of 4N or a mixed gas of nitrogen having a purity of 4N and hydrogen (hydrogen concentration: 3% by volume)) and three types of heating temperature (120° C., 150° C., 200° C.), resulting in sintered compacts. The volume resistivity of each of the obtained sintered compacts was measured by the four-probe method using a resistivity meter (Loresta GP made by Mitsubishi Chemical Analytech Co., Ltd.). The results are shown in Table 1. In Table 1, in the "atmosphere" column of the "heating conditions", "$N_2$" is written when heating was performed in a nitrogen atmosphere having a purity of 4N, and "$N_2$—$H_2$ (3%)" is written when heating was performed in an atmosphere of a mixed gas (hydrogen concentration: 3% by volume) of nitrogen having a purity of 4N and hydrogen. In addition, when the heating condition of Sample No. 2 was "pressure: normal pressure, heating temperature: 120° C., atmosphere: $N_2$", since the resistance of the sintered compact was very high (>$10^7$ Ω) and the volume resistivity could not be measured, "–" was written in the volume resistivity column.

TABLE 1

| | Mass ratio (% by mass) | | | Heating conditions | | | |
|---|---|---|---|---|---|---|---|
| | | | | | Heating temperature | | Volume resistivity |
| | Cu | $Cu_{64}O$ | $Cu_2O$ | Pressure | (° C.) | Atmosphere | (Ω · cm) |
| Sample No. 1 | 98.5 | 1.2 | 0.3 | Normal pressure | 200 | $N_2$ | $2.7 \times 10^{-5}$ |
| | | | | Normal pressure | 200 | $N_2$—$H_2$ (3%) | $1.9 \times 10^{-5}$ |
| | | | | Normal pressure | 150 | $N_2$ | $7.9 \times 10^{-5}$ |
| | | | | Normal pressure | 150 | $N_2$—$H_2$ (3%) | $6.3 \times 10^{-5}$ |
| | | | | Normal pressure | 120 | $N_2$ | $2.3 \times 10^{-4}$ |
| | | | | Normal pressure | 120 | $N_2$—$H_2$ (3%) | $4.6 \times 10^{-4}$ |
| Sample No. 2 | 97.4 | 1.3 | 1.3 | Normal pressure | 200 | $N_2$ | $1.4 \times 10^{-5}$ |
| | | | | Normal pressure | 200 | $N_2$—$H_2$ (3%) | $6.2 \times 10^{-6}$ |
| | | | | Normal pressure | 150 | $N_2$ | 22 |
| | | | | Normal pressure | 150 | $N_2$—$H_2$ (3%) | $3.6 \times 10^{-4}$ |
| | | | | Normal pressure | 120 | $N_2$ | — |
| | | | | Normal pressure | 120 | $N_2$—$H_2$ (3%) | 6940 |

From the results in Table 1, it can be considered as follows. Sample Nos. 1 and 2 in Table 1 are examples satisfying all of the requirements specified in the embodiments of the present invention, and a sintered compact having a volume resistivity of $5.0\times10^{-4}$ Ω·cm or less and exhibiting sufficient conductivity was obtained by heating at 200° C. under normal pressure.

Sample No. 1 satisfied the requirement of one preferred embodiment of the present invention, that is, the mass ratio of $Cu_2O$ to the total mass of Cu, $Cu_{64}O$ and $Cu_2O$ of 0% by mass or more and less than 0.5% by mass. As a result, a sintered compact being $1.0\times10^{-4}$ Ω·cm or less and exhibiting high conductivity was obtained even when heated at 150° C. under normal pressure, and a sintered compact being $5.0\times10^{-4}$ Ω·cm or less and exhibiting sufficient conductivity was obtained even when heated at 120° C. under normal pressure.

Sample No. 2 satisfied the requirement of another preferred embodiment of the present invention, that is, the mass ratio of $Cu_2O$ to the total mass of Cu, $Cu_{64}O$ and $Cu_2O$ of 0.5 to 2.0% by mass, and a sintered compact having a volume resistivity of $1.5\times10^{-5}$ Ω·cm or less and exhibiting higher conductivity was obtained by heating at 200° C. under normal pressure.

In Sample Nos. 1 and 2, since a reducing gas $H_2$ was mixed with an inert gas $N_2$ at the time of heating, the volume resistivity was lower than that in the case of containing no $H_2$ except for the heating of Sample No. 1 at 120° C.

FIG. 5 shows an SEM image of a sintered compact resulting from heating the oxide-containing copper fine particles of Sample No. 1 to 120° C. under normal pressure in an atmosphere of a mixed gas (hydrogen concentration: 3% by volume) of nitrogen having a purity of 4N and hydrogen. FIG. 6 shows an SEM image of a sintered compact resulting from heating the oxide-containing copper fine particles of Sample No. 1 to 200° C. under normal pressure in an atmosphere of a mixed gas (hydrogen concentration: 3% by volume) of nitrogen having a purity of 4N and hydrogen. As compared with FIG. 5 (heating at 120° C., volume resistivity: $4.6\times10^{-4}$ Ω·cm), FIG. 6 (heating at 200° C., volume resistivity: $1.9\times10^{-5}$ Ω·cm) showed that the copper fine particles formed necking with each other well.

Further, the oxide-containing copper fine particles of Sample No. 3 were prepared as described below, and the bonding strength as a bonding material was investigated for Sample No. 3. As a background of the investigation of the bonding strength, with a recent increase in operating temperature of a power semiconductor, there has been a case where sufficient strength cannot be obtained due to a low melting point of solders conventionally used as a bonding material. Therefore, a metal bonding material having a higher melting point and the lowering of the bonding temperature have been demanded. In view of such a background, the bonding strength was investigated in order to examine the applicability of the oxide-containing copper fine particles according to the embodiments of the present invention as a bonding material.

The copper fine particles prepared in the same manner as in the cases of Sample Nos. 1 and 2 were added to a dispersing medium, and dispersed by using a high-pressure wet type atomizer (Star Burst Mini (made by Sugino Machine Limited)). Triethanolamine was used as the dispersing medium, and the content of the copper fine particles was set to 90% by mass. In addition, the jetting pressure at the time of the dispersion was set to 150 MPa, and the dispersion was performed while cooling the dispersion liquid after jetting in an ice bath at 0° C., and this operation was repeated five times (that is, the number of passes was set to five). After the completion of the dispersion, oxide-containing copper fine particles dispersed in triethanolamine and coated with caproic acid (Sample No. 3) were obtained. For Sample No. 3, an XRD pattern was obtained in the same manner as in the cases of Sample Nos. 1 and 2, and the mass ratios of Cu, $Cu_{64}O$, and $Cu_2O$ to the total mass of Cu, $Cu_{64}O$, and $Cu_2O$ were calculated. As a result, Cu: 98.8% by mass and $Cu_{64}O$: 1.2% by mass were obtained, and $Cu_2O$ was not detected.

For Sample No. 3, the bonding strength as a bonding material was investigated.

First, using the oxide-containing copper fine particles of Sample No. 3, the bonding strength when test pieces were bonded without pressurization was investigated as follows.

A cylindrical copper test piece 1 (φ 5 mm, height 5 mm) and a cylindrical copper test piece 2 (φ 12 mm, height 5 mm) were prepared, and the surface of flat parts of each test piece was mirror-polished (alumina having a grain size of #4000 and alumina having a grain size of 0.5 μm were sequentially used as polishing agents). After the polishing, the cylindrical copper test piece 1 and the cylindrical copper test piece 2 were washed with dilute hydrochloric acid. After the washing, the oxide-containing copper fine particles of Sample No. 3 were applied to one of the flat portions of the cylindrical copper test piece 2. Note that, at the time of the application, the fine particles were to be applied only to the central part of the flat portion using a metal mask having a circular opening (φ 12 mm, thickness 0.15 mm, opening: ep 5 mm). One of the flat portions of the cylindrical copper test piece 1 was closely contacted with the applied surface (φ 5 mm) and held for 30 seconds with a load of 160 g added thereto. Thereafter, the cylindrical copper test piece 1 and the cylindrical copper test piece 2 were placed and heated in a heating furnace filled with an inert gas atmosphere by a $N_2$ flow of 100 mL/min. The profile of the temperature (and the pressure) during the heating is shown in FIG. 7. FIG. 7 shows that the heating temperature was 200° C. or lower.

As described above, the cylindrical copper test piece 1 and the cylindrical copper test piece 2 were bonded without pressurization using the oxide-containing copper fine particles of Sample No. 3.

Bonding strength was measured using the test pieces bonded as described above. FIG. 8 is a schematic diagram for explaining the method for measuring the bonding strength. As shown in FIG. 8, the cylindrical copper test piece 1 was sandwiched between jigs 3, and a maximum load (MPa) applied when the cylindrical copper test piece 2 was moved in the direction of the dashed arrow at 1 mm/min was evaluated as bonding strength. FIG. 9 shows the result of the bonding strength measurement. The movement in the direction of the dashed arrow and the detection of the load at the time of bonding strength measurement in FIG. 8 were performed using an automatic servo stand (JSV-H1000, made by Japan Instrumentation System Co., Ltd.) and a handy digital force gauge (HF-100, made by Japan Instrumentation System Co., Ltd.). FIG. 9 showed that the bonding strength achieved when the cylindrical copper test piece 1 and the cylindrical copper test piece 2 were bonded together without pressurization using the oxide-containing copper fine particles of Sample No. 3 was 17.0 MPa.

The bonded surfaces (fracture surfaces) of the cylindrical copper test pieces 1 and 2 after the bonding strength measurement were observed with an optical microscope (VHX-7000, made by KEYENCE CORPORATION). FIG. 10 shows an optical microscopic image of the fracture surface of the cylindrical copper test piece 1. FIG. 11 shows an optical microscopic image of the fracture surface of the cylindrical copper test piece 2. FIGS. 10 and 11 showed that the sintered compact of the oxide-containing copper fine particles of Sample No. 3 remained more on the cylindrical copper test piece 2 than on the cylindrical copper test piece 1. Further, the fracture surface of the cylindrical copper test piece 2 was observed using an FE-SEM (JSM-6701F, made by JEOL Ltd.). FIG. 12 shows an FE-SEM image of the fracture surface of the cylindrical copper test piece 2. As shown in FIG. 12, the oxide-containing copper fine particles of Sample No. 3 formed necking with each other well as in FIG. 6, and a good sintered state was observed. Therefore, the sintered compact of the oxide-containing copper fine particles shown in FIG. 12 is considered to exhibit sufficient conductivity.

Next, using the oxide-containing copper fine particles of Sample No. 3, the bonding strength when test pieces were bonded with pressurization was investigated as follows.

The oxide-containing copper fine particles of Sample No. 3 were applied to the cylindrical copper test piece 2 in the same manner as described above. One of the flat portions of the cylindrical copper test piece 1 was closely contacted with the applied surface (φ 5 mm) and held for 10 seconds with a load of 5 kg applied thereto. Thereafter, the cylindrical copper test piece 1 and the cylindrical copper test piece 2 were placed in a heating furnace filled with an inert gas atmosphere by a $N_2$ flow of 100 mL/min, and heated while the flat portions of the test pieces were pressurized by applying a load thereto. The profile of the temperature and the pressure during the heating is shown in FIG. 13. FIG. 13 shows that the heating temperature was 200° C. or lower.

Bonding strength was measured using the test pieces bonded as described above. As shown in FIG. 8, the cylindrical copper test piece 1 was sandwiched between jigs 3, and a maximum load (MPa) applied when the cylindrical copper test piece 2 was moved in the direction of the dashed arrow at 1 mm/min was evaluated as bonding strength. FIG. 14 shows the result of the bonding strength measurement. The movement in the direction of the broken line arrow and the detection of the load at the time of bonding strength measurement in FIG. 8 were performed using a compact tabletop tester (EZ-X, made by Shimadzu Corporation). FIG. 14 showed that the bonding strength achieved when the cylindrical copper test piece 1 and the cylindrical copper test piece 2 were bonded together with pressurization using the oxide-containing copper fine particles of Sample No. 3 was 63.9 MPa.

The bonded surfaces (fracture surfaces) of the cylindrical copper test pieces 1 and 2 after the bonding strength measurement were observed with an optical microscope (VHX-7000, made by KEYENCE CORPORATION). FIG. 15 shows an optical microscopic image of the fracture surface of the cylindrical copper test piece 1. FIG. 16 shows an optical microscopic image of the fracture surface of the cylindrical copper test piece 2. FIGS. 15 and 16 showed that the sintered compact of the oxide-containing copper fine particles of Sample No. 3 remained on both the cylindrical copper test piece 1 and the cylindrical copper test piece 2. Further, the fracture surface of the cylindrical copper test piece 2 was observed using an FE-SEM (JSM-6701F, made by JEOL Ltd.). FIG. 17 shows an FE-SEM image of the fracture surface of the cylindrical copper test piece 2. As shown in FIG. 17, the oxide-containing copper fine particles of Sample No. 3 formed necking with each other well, and a good sintered state was observed. Therefore, the sintered compact of the oxide-containing copper fine particles shown in FIG. 17 is considered to exhibit sufficient conductivity.

The present application claims the priority to Japanese Patent Application No. 2020-144680 filed on Aug. 28, 2020. Japanese Patent Application No. 2020-144680 is incorporated herein by reference in its entirety.

INDUSTRIAL APPLICABILITY

The oxide-containing copper fine particles according to the embodiments of the present invention require neither two-steps heating nor additional copper materials, and the sintered compact that exhibits sufficient conductivity is obtained by one-step heating at 200° C. or lower under normal pressure (or a pressure not lower than normal pressure). Therefore, the oxide-containing copper fine particles can be used as, for example, a circuit forming material of a printed circuit board (especially, a flexible substrate) and other fine wiring materials, as well as a die bonding material of a power semiconductor for heat conduction applications. Further, the oxide-containing copper fine particles can also be used as an antistatic material, an electromagnetic wave shielding material, an infrared shielding material, or the like.

The invention claimed is:

1. Oxide-containing copper fine particles comprising $Cu_{64}O$ and optionally $Cu_2O$ and coated with a carboxylic acid, wherein a mass ratio of $Cu_{64}O$ to a total mass of Cu, $Cu_{64}O$ and $Cu_2O$ is 0.5 to 2.0% by mass.

2. The oxide-containing copper fine particles according to claim 1, wherein a mass ratio of $Cu_2O$ to the total mass of Cu, $Cu_{64}O$ and $Cu_2O$ is 0% by mass or more and less than 0.5% by mass.

3. The oxide-containing copper fine particles according to claim 1, wherein a mass ratio of $Cu_2O$ to the total mass of Cu, $Cu_{64}O$ and $Cu_2O$ is 0.5 to 2.0% by mass.

4. A method for producing the oxide-containing copper fine particles according to claim 1, wherein the method comprises:

preparing copper fine particles;

coating the copper fine particles with a carboxylic acid; and adding the copper fine particles coated with the carboxylic acid to a dispersing medium and dispersing the copper fine particles by using a bead mill or a high-pressure wet type atomizer.

5. The method according to claim 4, wherein the dispersing is performed under an inert gas atmosphere.

6. The method according to claim 4, wherein the dispersing is performed under a normal air atmosphere.

7. The method according to claim 4, wherein a rotation speed of an agitator of the bead mill is 1000 rpm or more and less than 3000 rpm.

8. A method for producing a copper fine particle sintered compact, wherein the method comprises heating the oxide-containing copper fine particles according to claim 1 to 100° C. to 200° C. under an inert gas atmosphere.

9. The method according to claim 8, wherein the inert gas comprises $N_2$.

10. The method according to claim 9, wherein the inert gas is mixed with less than 4% by volume of $H_2$.

11. A method for producing the oxide-containing copper fine particles according to claim 2, wherein the method comprises:

preparing copper fine particles;

coating the copper fine particles with a carboxylic acid; and adding the copper fine particles coated with the carboxylic acid to a dispersing medium and dispersing the copper fine particles by using a bead mill or a high-pressure wet type atomizer under an inert gas atmosphere.

12. The method according to claim 11, wherein a rotation speed of an agitator of the bead mill is 1000 rpm or more and less than 3000 rpm.

13. A method for producing the oxide-containing copper fine particles according to claim 3, wherein the method comprises:

preparing copper fine particles;

coating the copper fine particles with a carboxylic acid; and adding the copper fine particles coated with the carboxylic acid to a dispersing medium and dispersing the copper fine particles by using a bead mill or a high-pressure wet type atomizer under a normal air atmosphere.

14. The method according to claim 13, wherein a rotation speed of an agitator of the bead mill is 1000 rpm or more and less than 3000 rpm.

15. A method for producing a copper fine particle sintered compact, wherein the method comprises heating the oxide-containing copper fine particles according to claim 2 to 100° C. to 200° C. under an inert gas atmosphere.

16. The method according to claim 15, wherein the inert gas comprises $N_2$.

17. A method for producing a copper fine particle sintered compact, wherein the method comprises heating the oxide-containing copper fine particles according to claim 3 to 100° C. to 200° C. under an inert gas atmosphere.

18. The oxide-containing copper fine particles according to claim 1, wherein the carboxylic acid comprises at least one compound selected from the group consisting of aliphatic monocarboxylic acids, aliphatic dicarboxylic acids, aromatic carboxylic acids, and terpene-based carboxylic acids.

19. The oxide-containing copper fine particles according to claim 1, wherein $Cu_{64}O$ is present on a surface of the oxide-containing copper fine particles.

20. Oxide-containing copper fine particles comprising $Cu_{64}O$ and $Cu_2O$ and coated with a carboxylic acid, wherein a mass ratio of $Cu_{64}O$ to a total mass of Cu, $Cu_{64}O$ and $Cu_2O$ is 0.5 to 2.0% by mass.

* * * * *